US012342875B2

(12) United States Patent
Middleton

(10) Patent No.: US 12,342,875 B2
(45) **Date of Patent: *Jul. 1, 2025**

(54) BREAST SEPARATOR DEVICES

(71) Applicant: Lynn Middleton, Midlothian, VA (US)

(72) Inventor: Lynn Middleton, Midlothian, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/382,423

(22) Filed: Oct. 20, 2023

(65) Prior Publication Data

US 2024/0049808 A1 Feb. 15, 2024

Related U.S. Application Data

(63) Continuation-in-part of application No. 17/994,535, filed on Nov. 28, 2022, now Pat. No. 11,856,998, which is a continuation of application No. 17/747,825, filed on May 18, 2022, now Pat. No. 11,533,955.

(60) Provisional application No. 63/190,584, filed on May 19, 2021.

(51) Int. Cl.
*A41C 3/00* (2006.01)

(52) U.S. Cl.
CPC ..... *A41C 3/005* (2013.01)

(58) Field of Classification Search
CPC ..... A41C 3/005
See application file for complete search history.

(56) References Cited

U.S. PATENT DOCUMENTS

| | | | | |
|---|---|---|---|---|
| 7,001,239 | B2 | 2/2006 | Russell | |
| 7,144,295 | B2 | 12/2006 | Fisher | |
| 8,047,892 | B1 | 11/2011 | Dempsey | |
| 8,845,388 | B1 | 9/2014 | Dempsey | |
| 11,533,955 | B2 * | 12/2022 | Middleton | A41C 3/005 |
| 11,856,998 | B2 * | 1/2024 | Middleton | A41C 3/005 |
| 12,041,977 | B2 * | 7/2024 | Brandt | B32B 5/24 |
| 2012/0028541 | A1 | 2/2012 | Donnelly et al. | |
| 2013/0036553 | A1 | 2/2013 | Mann Kass | |
| 2016/0120235 | A1 | 5/2016 | Scotto | |
| 2019/0059457 | A1 | 2/2019 | Castelazo | |
| 2019/0059460 | A1 | 2/2019 | Brazill | |
| 2020/0383392 | A1 | 12/2020 | Brandt et al. | |

(Continued)

FOREIGN PATENT DOCUMENTS

| | | | |
|---|---|---|---|
| CA | 2575534 | A1 | 7/2008 |
| DE | 102012009472 | A1 | 11/2013 |

(Continued)

OTHER PUBLICATIONS

International Search Report and Written Opinion for PCT/US2022/029890 mailed Sep. 2, 2022, 10 pages.

(Continued)

*Primary Examiner* — Gloria M Hale

(74) *Attorney, Agent, or Firm* — Procopio, Cory, Hargreaves & Savitch LLP

(57) ABSTRACT

Breast separator devices and garments comprising separator devices are provided herein. In some aspects, a separator device can comprise a base surface, a front surface, a top end, a bottom end, a first side surface, and a second side surface. In some aspects, the top end has a generally trapezoid shape with a rounded front edge. In some aspects, the separator devices described herein can comprise perforations (through-holes) for breathability.

20 Claims, 17 Drawing Sheets

(56) References Cited

U.S. PATENT DOCUMENTS

| | | | | |
|---|---|---|---|---|
| 2022/0245985 | A1* | 8/2022 | Bhutani | G07F 11/16 |
| 2023/0096106 | A1* | 3/2023 | Middleton | A41C 3/12 450/1 |
| 2024/0049808 | A1* | 2/2024 | Middleton | A41C 3/14 |

FOREIGN PATENT DOCUMENTS

| | | | |
|---|---|---|---|
| DE | 202013011873 | U1 | 9/2014 |
| GB | 2553343 | A | 3/2018 |
| WO | 2009149529 | A1 | 12/2009 |
| WO | 2018042174 | A1 | 3/2018 |

OTHER PUBLICATIONS

Extended European Search Report dated Sep. 30, 2024 in European Patent Application No. 22805428.4.
Communication pursuant to Article 94(3) EPC dated May 9, 2025 in European Patent Application No. 22805428.4.

* cited by examiner

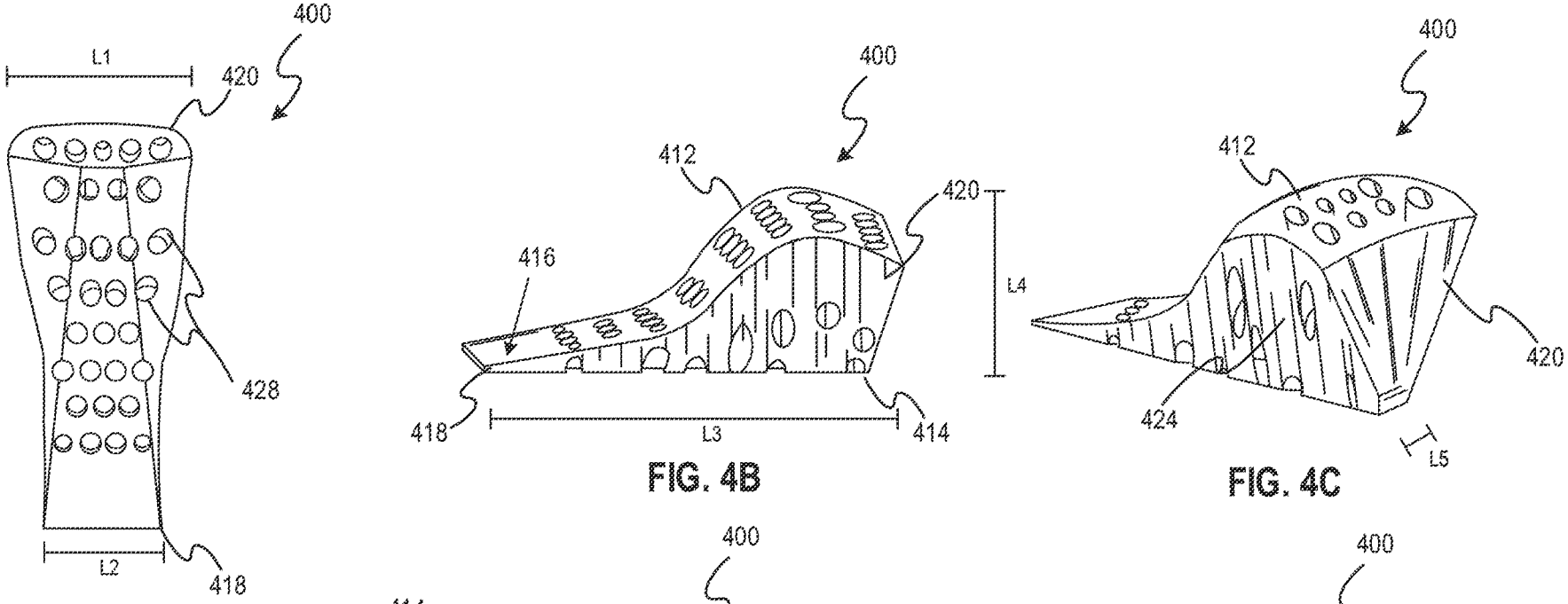
FIG. 4C
FIG. 4B
FIG. 4A
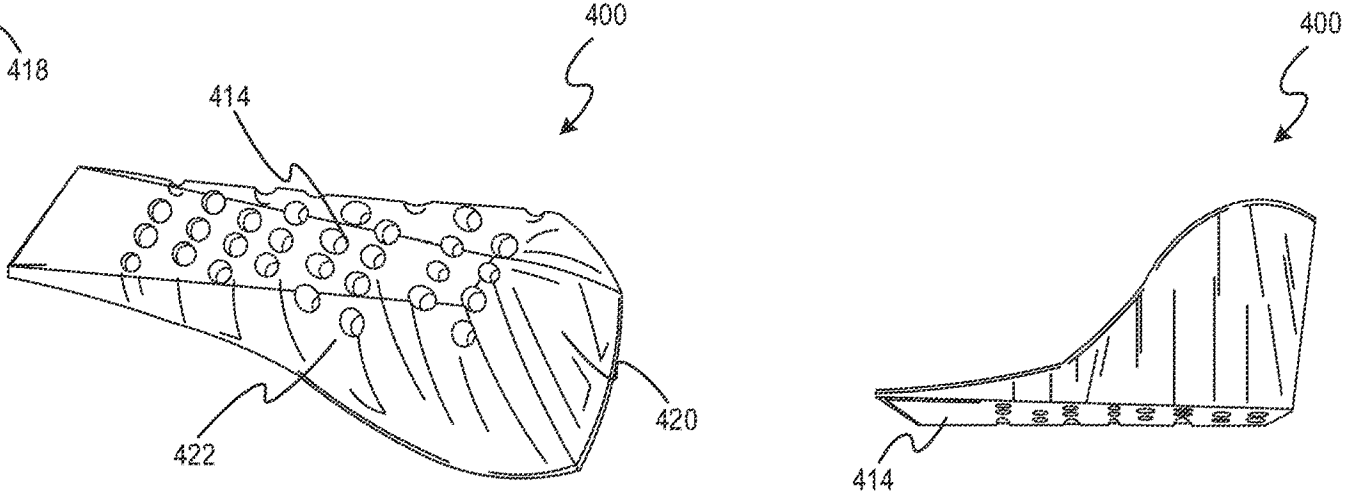
FIG. 4E
FIG. 4D

BREAST SEPARATOR DEVICES

CROSS-REFERENCE TO RELATED APPLICATIONS

This application is a continuation in part of U.S. patent application Ser. No. 17/994,535, filed on Nov. 28, 2022, now U.S. Pat. No. 11,856,998, which is a continuation of U.S. patent application Ser. No. 17/747,825, filed on May 18, 2022, now U.S. Pat. No. 11,533,955, which claims priority to U.S. Provisional Patent App. No. 63/190,584, filed on May 19, 2021. These and all other extrinsic materials discussed herein, including publications, patent applications, and patents, are incorporated by reference in their entirety. Where a definition or use of a term in an incorporated reference is inconsistent or contrary to the definition of that term provided herein, the definition of that term provided herein applies and the definition of the term in the reference does not apply.

BACKGROUND

Field of the Invention

The present disclosure relates generally to breast separator devices, and more particularly to breast separator devices for use with garments.

Description of the Related Art

Others have attempted to help a person modify the appearance of their breasts and cleavage, for example, through the use of padded bras that make their breasts appear larger. For a person who already has larger breasts, bras and other clothing often exert external pressure causing the breasts to contact each other in the cleavage area. The contact may result in what may be referred to as "breast crack", "boob crack", uniboob, or breast cleft. This breast cleft is not a wrinkle, but the depression between the breasts that appears when the breasts are pushed together so tightly can make them appear similar to an intergluteal cleft. This breast cleft happens most often for persons with larger breasts due to the breast being made of soft tissue that can easily be pushed towards each other with little external force. That external force typically comes from garments worn over the breast area such as bras, sports bras, shapewear or clothing.

Often occurrence of breast cleft may be problematic and undesirable. For example, often a more desirable appearance in the cleavage area may be achieved if the breasts are separated and contact therebetween is reduced. Furthermore, breast cleft may be undesirable because the contact may result in chafing or sweat building up between the breasts in the cleavage areas. Currently, there are limited options available that help prevent the formation of the breast cleft, the chafing or the sweat build up that can occur in the cleavage areas as a result.

SUMMARY

Accordingly, devices, systems and methods are provided herein that can advantageously create and/or maintain a separation between breasts, even when a padded, underwired or otherwise enhancing bra is worn by the wearer.

In some aspects, the separator device prevents chafing from breasts rubbing against each other.

In some aspects, a separator device is provided, comprising a base surface, a front surface, a top end, a bottom end, a first side surface extending between the top end and the bottom end, and between the base surface and the front surface on a first side, and a second side surface extending between the top end and the bottom end, and between the base surface and the front surface on a second side.

The separator devices described herein can have any suitable size and shape. For example, a separator device can have a top end portion having a first width (e.g., a maximum width), a bottom end portion having a second width (e.g., a maximum width), and wherein the first width is at least 10% greater than the second width. In some aspects, a base surface portion at the top end portion has a first width (e.g., a maximum width), a front surface portion at the top end portion has a second width (e.g., a maximum width), and the second width is at least 110%, at least 120%, at least 130%, at least 140%, or at least 150% the first width. In some aspects, the device has a first thickness at the bottom end portion (e.g., a maximum thickness between the base surface and front surface at the bottom end portion), a second thickness at the top end portion (e.g., a maximum thickness between the base surface and the front surface at the top end portion), and the second thickness is at least 150%, at least 200%, at least 250%, or at least 300% the first thickness. In some aspects, the device can have a third thickness between the first thickness and the second thickness, and the third thickness can be greater than the second thickness. In some aspects, the base surface can comprise a generally trapezoid shape. In some aspects, the base surface can comprise a triangular shape. In some aspects, the base surface can comprise a triangular shape portion and a rectangular or trapezoid shape portion. In some aspects, the base surface can be flat or substantially flat. In some aspects, the front surface can comprise a bottom portion and a top portion, and the bottom portion can comprise an inclined plane, and the entire top portion can be curved.

In some aspects, a first angle of between 95-165 degrees, between 100-165 degrees, or between 105-150 degrees can be formed by the base surface and the first side surface at the top end. In some embodiments, a second angle of between 95-165 degrees, between 100-165 degrees, or between 105-150 degrees can be formed by the base surface and the second side surface at the top end.

The separator devices described herein can be made of any suitable material or materials, including, for example, one or more of a silicone, a foam, a rubber, and a plastic. The separator devices can optionally include a plurality of openings for breathability. Such openings can extend through the device, for example, from one or more of the front surface to the bottom end, the front surface to the first side surface, the front surface to the second side surface, the base surface to the bottom end, the base surface to the first side surface, the base surface to the second side surface, the first side surface to the second side surface, the base surface to the front surface and the first side surface, and the base surface to the front surface and the second side surface. One, some or all of the openings can extend perpendicularly or substantially perpendicularly to the base surface. The separator devices described herein can have a uniform or non-uniform thickness.

In some aspects, a breast separation system is provided, comprising a garment coupled (directly or indirectly) to a separator device (e.g., any of the separator devices described herein). The garment can comprise a bra (e.g., a sports bra, a t-shirt bra, a strapless bra) or other undergarment, a tank top, a short sleeved shirt, a long sleeved shirt, a crop top, or any other suitable garment. In some aspects, the separator device can be sewn onto a front portion of the garment. In some aspects, the separator device can be removably coupled to the garment (e.g., via a fastener or pocket, or being positioned between two or more layers of a front portion of the garment). In some aspects, the separator device can be attached to the garment via an adhesive.

The separator devices described herein can be configured to fit within a cleavage area formed between breasts. The separator devices can be provided on a garment worn by the wearer and be configured to maintain separation between the breasts within the cleavage.

In some aspects of the disclosure, a breast separator device for a wearer having a cleavage area between a first breast and a second breast, the breast separator device comprising: an elongated body comprising a base surface, a front surface, a top end, a bottom end, a first side surface extending between the top end and the bottom end, and between the base surface and the front surface on a first side, and a second side surface extending between the top end and the bottom end, and between the base surface and the front surface on a second side; at least one wing extending outward from the elongated body; wherein the first side surface and second side surface form an angle of between 50-170 degrees at the top end; wherein the elongated body has a first thickness at the top end that is greater than a second thickness at the bottom end; and wherein the elongated body, when placed within the cleavage area between the first breast and the second breast, is configured to maintain a separation between the first breast and the second breast in the cleavage area. In some embodiments, the separator device is made at least in part of a silicone. In some embodiments, the breast separator device further has a plurality of openings extending from the front surface to at least one of the base surface, the first side surface, and the second side surface. In some embodiments, the at least one wing comprises a first wing and a second wing, wherein the first wing extends outward from the first side surface, and wherein the second wing extends outward from the second side surface. In some embodiments, a base surface portion at a top end portion has a first width, wherein a front surface portion at the top end portion has a second width, and wherein the second width is at least 120% the first width. In some embodiments, the first side surface and the second side surface are parallel or about parallel at the bottom end. In some embodiments, the base surface has a first portion comprising a triangular shape. In some embodiments, the base surface has a trapezoid shape. In some embodiments, the base surface is substantially flat, and wherein the device is made at least in part of a sweat resistant material. In some embodiments, the front surface has a bottom portion and a top portion, wherein the bottom portion comprises an inclined plane, and wherein the entire top portion is curved. In some embodiments, the device has a non-uniform thickness. In some embodiments, a length from the top end to the bottom end is between 1.5-8 inches. In some embodiments, the breast separator device is made at least in part of at least one of a sweat resistant material, a bacteria resistant material, a waterproof material, and a hypoallergenic material. In some embodiments, the breast separator device is made at least in part of a foam. In some embodiments, the at least one wing is made of a different material than the elongated body. In some embodiments, the at least one wing is made of the same material than the elongated body. In some embodiments, the at least one wing and the elongated body comprise a single piece of material. In some embodiments, the breast separator device further comprises an attachment portion sized and dimensioned to be positioned under a band at a bridge of a bra and having a substantially triangular prism shape. In some embodiments, an attachment portion is rounded at a bottom end. In some embodiments, the front surface has a first portion adjacent the top end with a convex shape and a second portion adjacent the bottom end with a concave shape. In some embodiments, the top end surface comprises a trapezoid shape with a rounded front edge. In some embodiments, the breast separator device is provided with a garment (e.g., a bra), and the garment comprises at least one receiver sized and dimensioned to allow a wing of the breast separator device to slide at least partially under and/or through it. In some embodiments, the breast separator device is provided with a garment (e.g., a bra), and the garment comprises at least one fastener complementary to a fastener of the breast separator device (e.g., complementary hook and loop, complementary snap fastening portions). In some embodiments, the breast separator device is provided with a garment (e.g., a bra), and the garment comprises a pocket or sleeve sized and dimensioned to receive and/or secure, at least temporarily, at least a portion of a breast separator device.

Other advantages and benefits of the disclosed system and methods will be apparent to one of ordinary skill with a review of the following description.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which:

FIG. 4A is a rear view of a separator device, according to another embodiment;

FIG. 4B is a side view of the separator device of FIG. 4A;

FIG. 4C is a top, side perspective view of the separator device of FIG. 4A;

FIG. 4D is another perspective view of the separator device of FIG. 4A;

FIG. 4E is a side view of the separator device of 4A with the base portion slightly lifted on one side;

FIG. 1013 is a top, rear view of the separator device of FIG. 10A;

FIG. 1113 is a rear view of the separator device of FIG. 11A;

DETAILED DESCRIPTION

Figure 1:
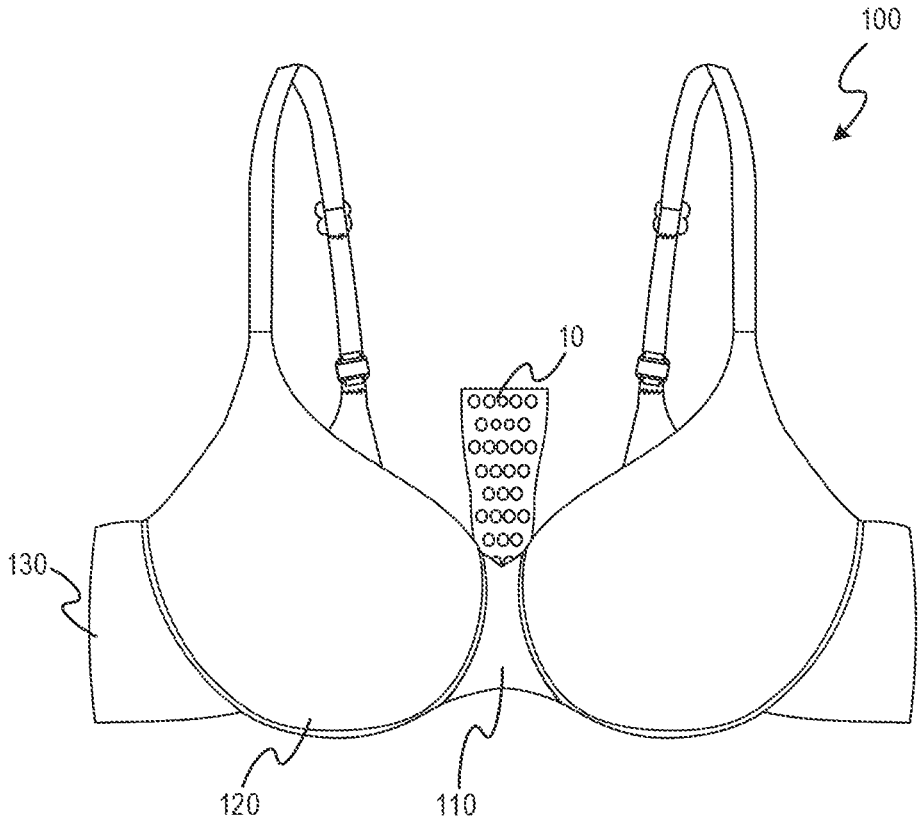
FIG. 1 is a front elevation view of a bra and with a separator device, according to an embodiment.

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent that those skilled in the art will be able to understand the disclosure without these specific details. In some instances, well-known structures and components are shown in simplified form for brevity of description. Some of the surfaces have been left out or exaggerated for clarity and ease of explanation.

The present disclosure is directed to a separator device (also referred to herein as a breast separator device or separator or device) which can be configured to maintain separation between breasts in a cleavage area such that the breasts are kept from contacting each other when wearing a tightly fitting garment (e.g., bras, shapewear, tank top, shirt, dress, or other items worn by a wearer.). In some aspects, the separator devices can comprise a base surface having a narrower width than the front surface across some or all of the length of the device (e.g., forming a "U" or "V" shaped cross-section, and/or a "U" or "V" shaped top end). In some aspects, the separator device can comprise an attachment portion configured to slide (or otherwise be positioned) between the garment and the wearer. As such, the separator device can be placed between breasts and held in place by the attachment portion, for example, by sliding the attachment portion under the front band of the garment. In some examples, the separator may be fixed to the garments and thereby positioned between the wearer and the garment when the garment is put on by the wearer.

The separator devices disclosed herein can advantageously address the occurrence of breast cleft, as well as sweat build up and chafing that can result from contact between breasts. For example, the separator devices can be configured to separate the breasts and keep the flesh of the breasts from contacting each other (e.g., at the cleavage area). Currently, limited options exist to prevent the formation of the breast cleft and/or sweat build up and/or chafing that can occur in a cleavage area as a result contact between breasts. In some embodiments, the separator device can be worn by the wearer and placed in contact with or adjacent skin between the breasts, within the cleavage area, to adjust the cleavage area by maintaining a separation between the breasts. In some embodiments, the separator device can be arranged to adjust the cleavage area so to maintain a space between breasts, for example, when an external pressure is applied to the breasts through wearing of bras, shapewear or other clothing. Generally, this external pressure while wearing a garment would press the breasts together causing contact between the breasts leading to breast cleft, chafing, and sweat build up. By inserting a separator device of the disclosure within the cleavage area between the breasts, a space or separation between the breasts can be formed and maintained. In some aspects, the external pressures from the garment worn may assist to keep the separator device of the disclosure in place when worn by a wearer. The suppleness of some of the embodiments herein may be similar to that of breast tissue, making it almost unnoticeable by the wearer. However, it should be appreciated that the separator devices described herein can be made of any suitable material(s), including, for example, a silicone, a rubber, a foam, a cloth, a plastic, and/or a combination thereof. By creating this space between the breasts, the separator devices described herein can also allow the chest area to stay cooler reducing the risk of chafing and sweating between the breasts in the cleavage area.

In some embodiments, a separator device of the disclosure can comprise an attachment portion or member that can be positioned between a garment (e.g., at a bridge or band of a bra that runs across the torso) and the wearer. The external pressure applied to the attachment portion due to wearing the garment may hold the device in place. In some embodiments, a separator device can be sewn into the garment at the desired location with consideration to where the cleavage area may occur (e.g., sewn into the band at the bridge of a bra), or placed within a pocket or between layers of a garment. In some embodiments, a fastener may removably couple the device to the garment (e.g., via a hook or loop fastener, a snap fastener, where one fastener component is coupled to the separator device and another fastener component is coupled to the garment). In some aspects, the devices herein can be configured to reduce the occurrence, and may even prevent, breast cleft while a wearer is awake going about their daily or evening routines. When the device is removed from the cleavage area and the wearer is no longer using the device, the breasts may return to their natural position, either as supported by the garment or unsupported thereby, for example, depending on if the wearer is wearing the garment or not.

The use of the term "breast" or "breasts" may be used to refer to, for example but not limited to, a female's breasts, breasts on a male (e.g., caused by pectoral fat, gynecomastia, etc.), any soft protruding organs or flesh supportable and shapeable by clothing and/or undergarments. Furthermore, the term "cleavage" may be used herein to refer to the depression between breasts, but may also be used herein to refer to any depression between two or more body parts creating a cleft like appearance therebetween. Further, sequential terminology, such as "first", "second", etc., may be used in the description and claims simply for labeling purposes and should not be limited to referring to described actions or items occurring in the described sequence. Actions or items may be ordered into a different sequence or may be performed in parallel or dynamically, without departing from the scope of the present application.

Referring now to FIG. 1, a separator device 10 is shown at least partially positioned under a garment 100, here, a bra. It should be appreciated that the garment can be any suitable garment, including undergarments (e.g., bras, sports bras, running bra, yoga bra), outerwear, shirts (e.g., tank tops, tube tops, long sleeve shirts, yoga tops, sports tops, tops with bras or breast pads integrated therein), or shapewear. Separator device 10 can be placed between the garment 100 and the wearer. In the example shown in FIG. 1, garment 100 is a bra, and the separator device 10 can be worn by the wearer (for example, on the wearer's skin or on any surface between the garment 100 and the wearer's skin, if applicable) between the cups 120, in the cleavage area to help maintain a space or separation between breasts supported by cups 120. The separator can be shaped to fit above the band 130, between the cups 120 along the bridge 110, or at any other suitable position relative to the garment 100.

Figure 2A:
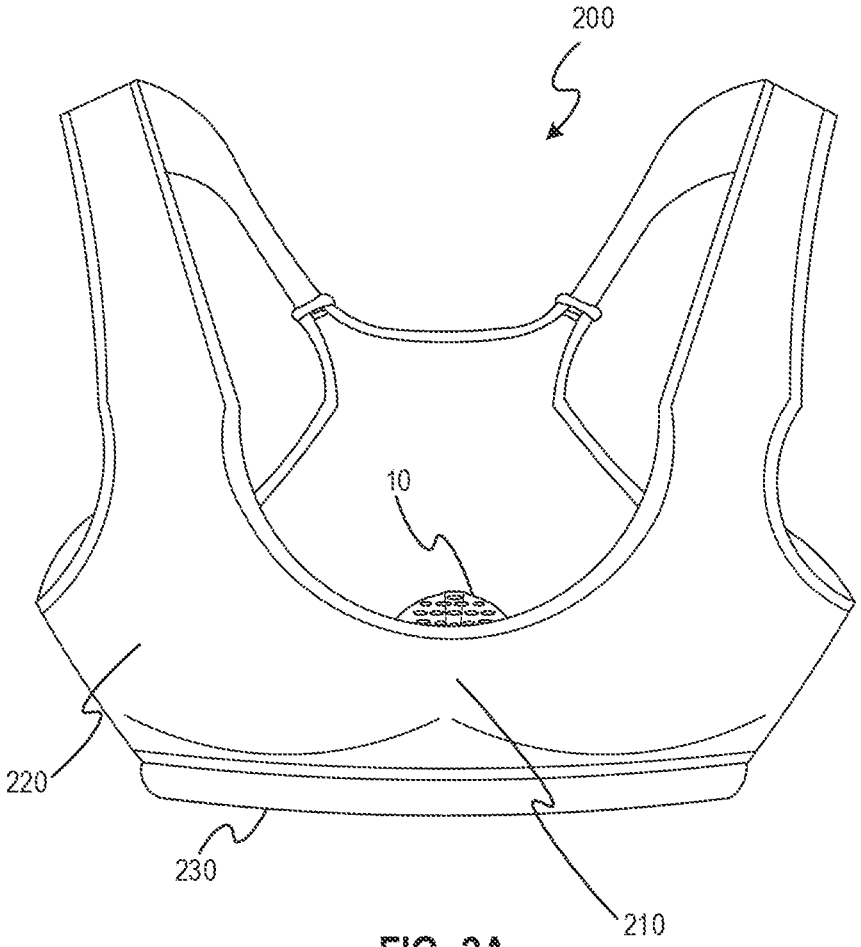
FIG. 2A is a perspective view showing a garment comprising a separator device affixed thereto, according to another embodiment.
Figure 2B:
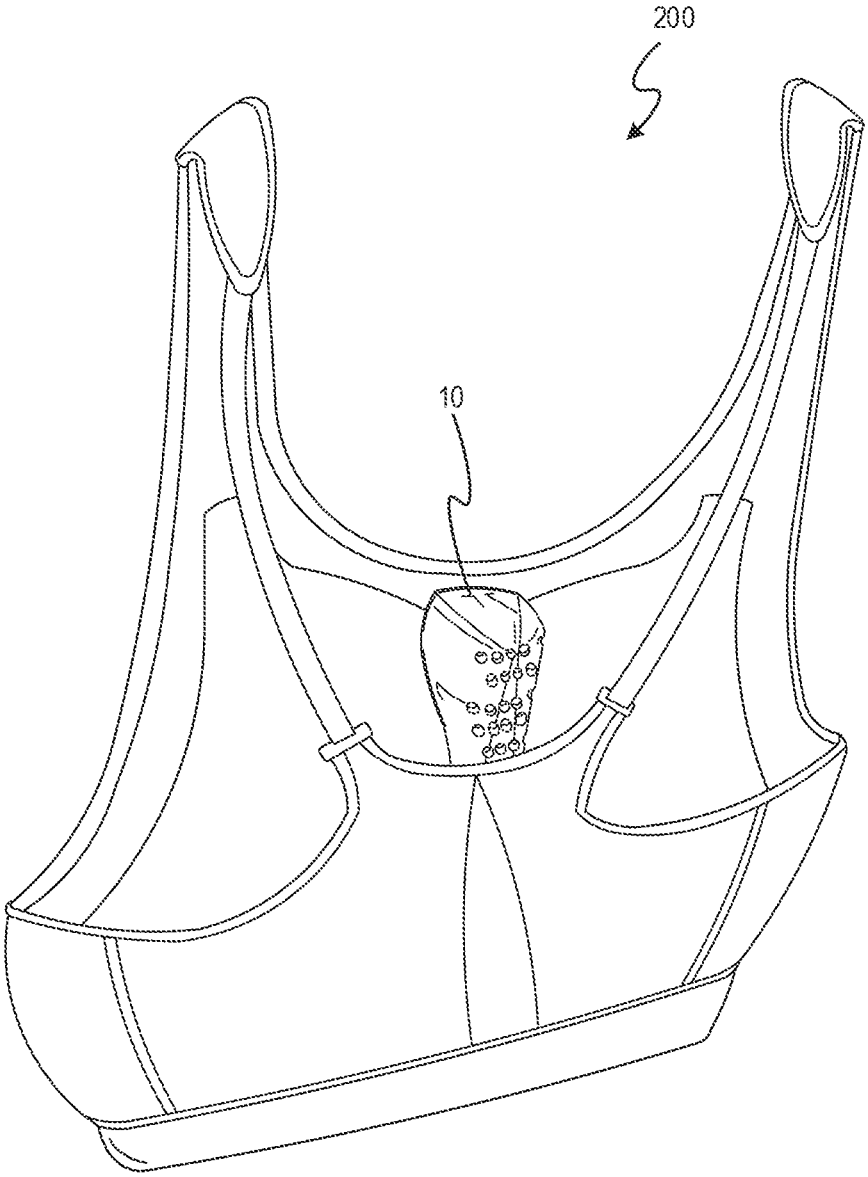
FIG. 2B is another perspective view showing a rear side of the garment of FIG. 2A.
Figure 2C:
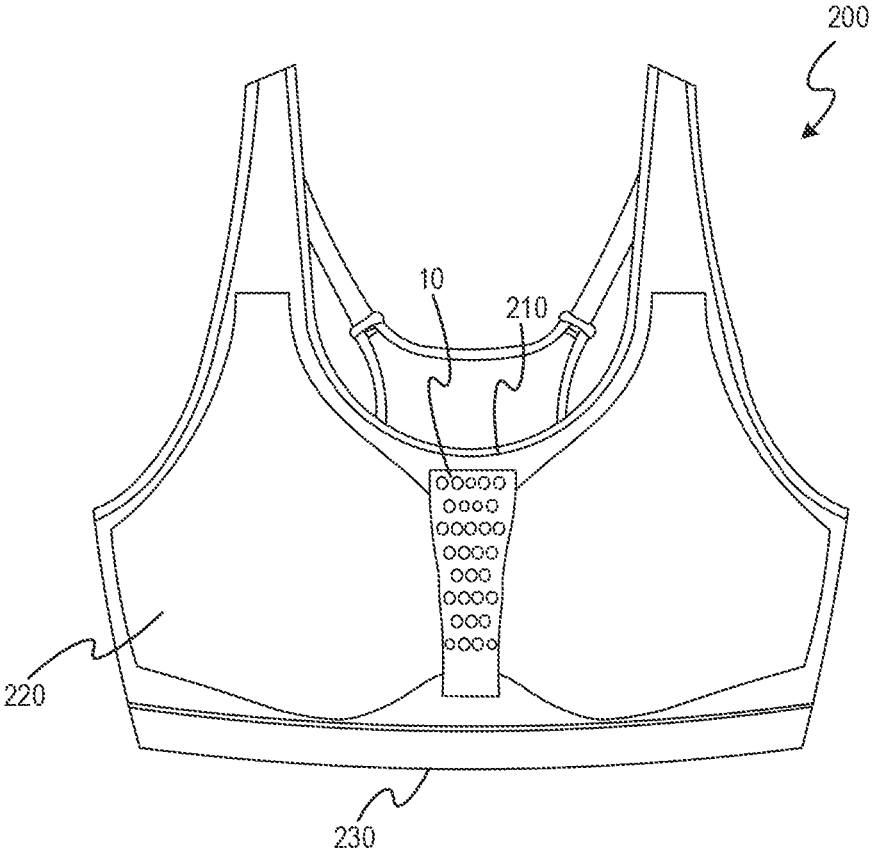
FIG. 2C is a front view of the garment of FIG. 2A, turned inside out.

Referring now to FIG. 2, separator device 10 is shown at least partially positioned under a garment 200, here, a sports (or exercise) bra. Separator device 10 can be placed between the garment 200 and a wearer. In the example shown in FIG. 2, garment 200 is a sports bra, and the separator device 10 can be worn by the wearer (for example, on the wearer's skin or on any surface between the garment 200 and the wearer's skin, if applicable) between the cups 220, in the cleavage area to help maintain a space or separation between breasts supported by cups 220. The separator can be shaped to fit above the band 230, between the cups 220 along the bridge 210, or at any other suitable position relative to the garment 200.

This separator device 10 can comprise any suitable separator device of the disclosure, including the separator devices shown in FIGS. 3A-3D, FIGS. 4A-4E, and FIGS. 5A-5D.

Now turning to FIGS. 3A-3D, a separator device 300 (sometimes referred to as a "separator") according to an embodiment is illustrated. Separator device 300 comprises an elongated body having a first surface 312 (referred to herein as a front surface) opposite a second surface 314 (referred to herein as a base surface), both extending from a first end 320 (referred to herein as the top end) opposite a second end 318 (referred to herein as the bottom end). Side surfaces 322 and 324, extending from the top end 320 to the bottom end 318 are provided on opposite sides and between front surface 312 and base surface 314. At the top end 320, the front surface 312 may be spaced apart from the base surface 314 by a first distance (or thickness) where a top end surface is formed between the front surface 312 and the base surface 314 and between side portion 322 and side portion 324. The length of the separator device 300 from the top end 320 to the bottom end 318 can be longer than the length between the side surface 322 to the side surface 324. At the bottom end 318, the front surface 312 may by spaced apart from the base surface 314 by a second distance, wherein the bottom end surface is formed between the front surface 312 and base surface 314 and between side surface 322 and side surface 324. In some aspects, the second distance (or thickness) of the bottom end can be substantially smaller than the first distance (or thickness) of the top end. For example, the first distance can be at least 200%, at least 300%, at least 400% or at least 500% greater than the second distance.

The front surface 312 and base surface 314 can be arranged to form an attachment portion (or attachment member) 316 at or adjacent the bottom end 318. The attachment portion 316 can be shaped to fit (e.g., via a sliding insertion) under a garment (e.g., garment 100), for example, under the band 130 at the bridge 110 running across a torso of the wearer. By inserting the attachment portion 316 under the band 130, and situating the separator device 300 within the cleavage area defined by the breasts, the garment, and the wearer, the separator 300 can at least one of form and maintain a space or separation between the breasts, for example, even when an external pressure (which may have caused the breasts to contact each other without the use of the separator) is applied. In some aspects, the external pressure can come from the garment, which can restrain the separator 300 at the desired location such that the adjustment of the cleavage area is maintained throughout the wearer's daily or evening routines. In the example shown in FIGS. 3A-3D, the second distance between the front surface 312 and the base surface 314 at bottom end 318 can be very small (e.g., less than 2 cm, less than 1.5 cm, less than 1 cm, less than 9 mm, less than 8 mm, less than 7 mm, less than 6 mm, less than 5 mm). In some aspects, the attachment portion can have a substantially triangular prism shape. In some aspects, the attachment portion can comprise a bottom portion of the separator device. In some aspects, the attachment portion 316 may be rounded at the bottom end for wearer's comfort. While a triangular prism shape (or substantially triangular prism shape) is illustrated in FIGS. 3A-3D, it should be appreciated that separator devices of the inventive subject matter can comprise any suitable shape, for example, to fit between the garment and a torso of the wearer without causing discomfort. It should also be appreciated that in some aspects, a separator device of the disclosure can lack an attachment portion, for example, where the separator device is sewn onto the garment or placed within a pocket or layers of a garment.

Figure 3C:
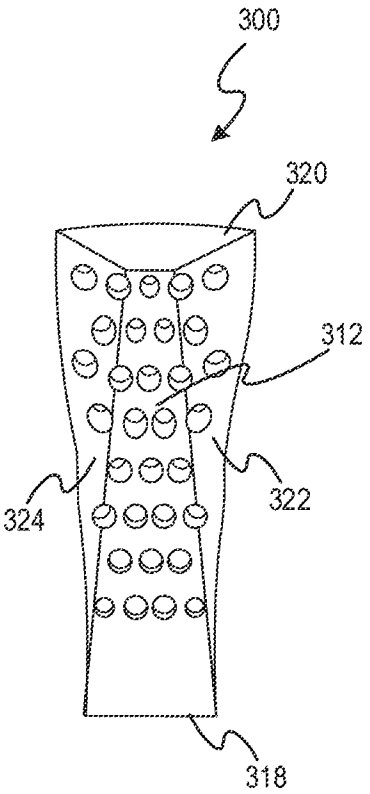
FIG. 3C is a rear view of the separator device of FIG. 3A.
Figure 3B:
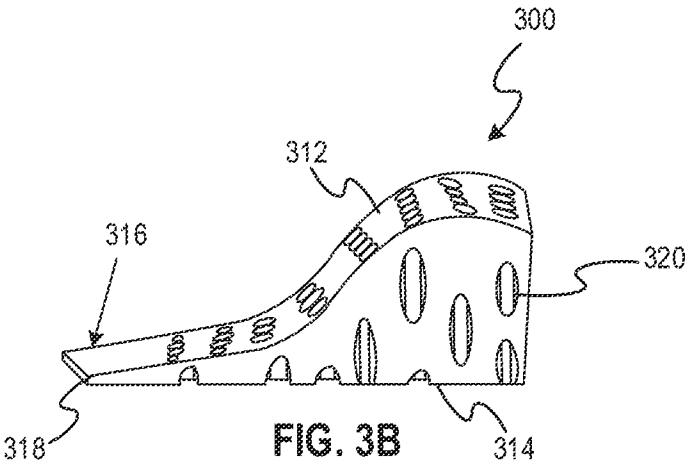
FIG. 3B is a side view of the separator device of FIG. 3A.
Figure 3D:
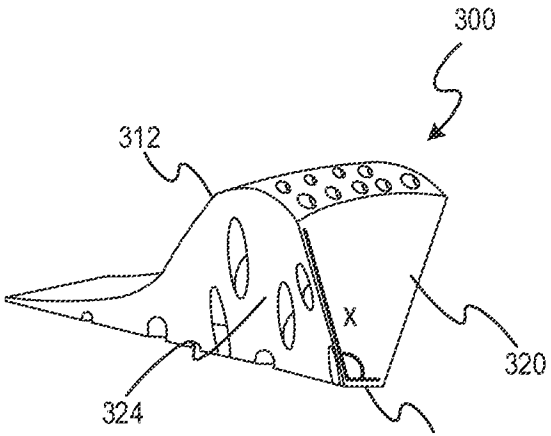
FIG. 3D is a top, side perspective view of the separator device of FIG. 3A.
Figure 3A:
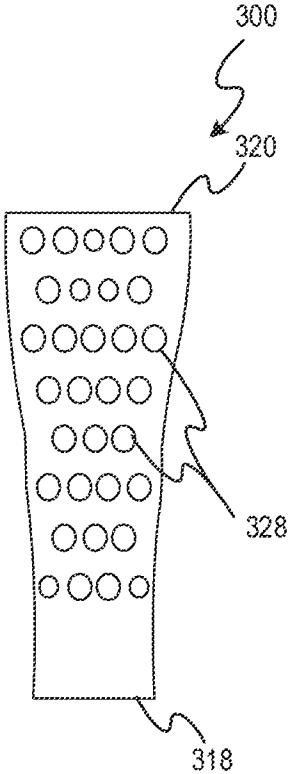
FIG. 3A is a front view of a separator device, according to an embodiment.
Figure 5D:
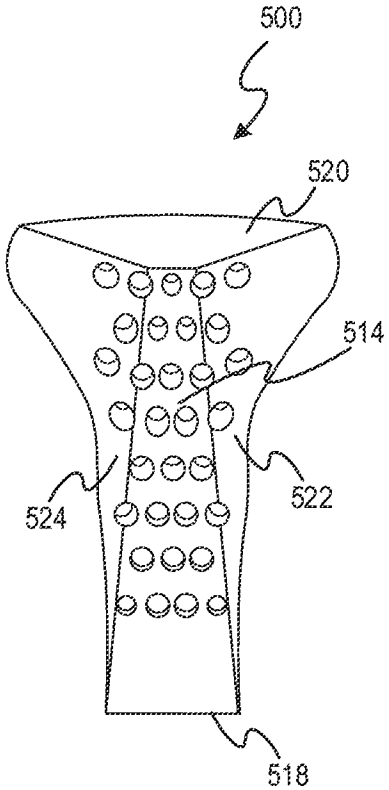
FIG. 5D is a rear view of the separation device of FIG. 5A.
Figure 5B:
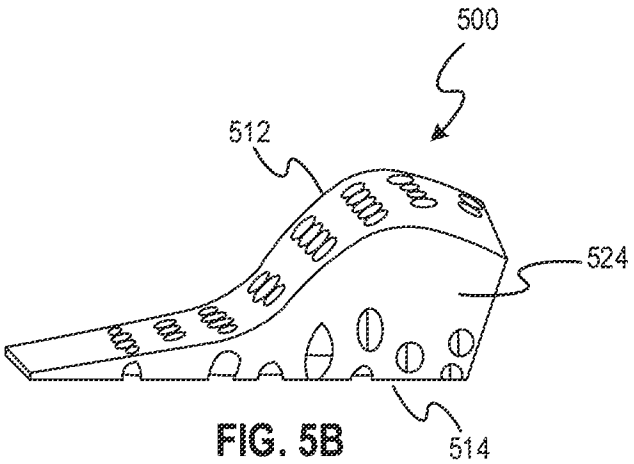
FIG. 5B is a side view of the separator device of FIG. 5A.
Figure 5C:
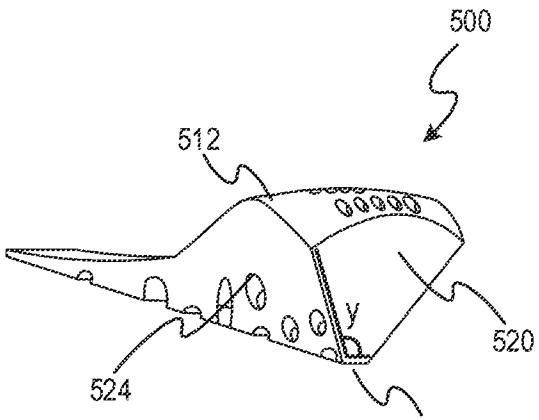
FIG. 5C is a top, side perspective view of the separator device of FIG. 5A.
Figure 5A:
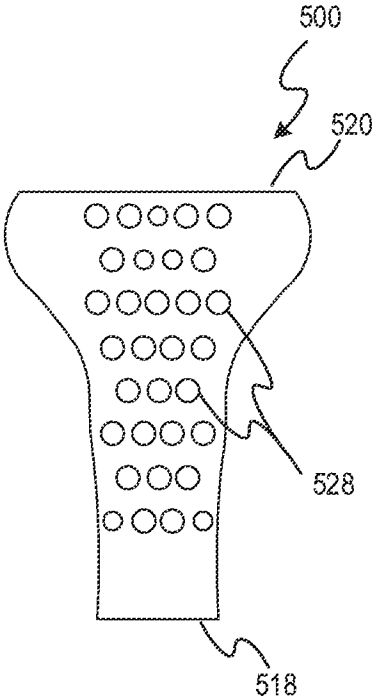
FIG. 5A is a front view of a separator device, according to another embodiment.

The front surface 312 may have any suitable shape, for example, a substantially planar surface or curved surface. For example, the front surface 312 can have a first portion (e.g., adjacent to the top end 320) with a concave shape and a second portion (e.g., adjacent the bottom end 318) can have a convex shape. In some aspects, the front surface 312 can have a first portion adjacent to the top end 320 with a convex shape and a second portion adjacent the bottom end 318 can have a concave shape. In some aspects, the front surface 312 may be planar (e.g., substantially flat) and inclined toward the bottom end 318 at an angle relative to the base surface 314, while having a bulging portion adjacent the top end 320. In some aspects the base surface 318 and front surface 312 can form an angle of between 5-45 degrees, or between 5-35 degrees or between 5-25 degrees at bottom end 318. Other curved shapes are possible. Similar to the front surface 312, the base surface 314 may also have any desired shape, for example, a substantially planar shape as illustrated in FIGS. 3A-3B. However, the base surface 314 may also be curved if so desired for wearer's comfort.

In some aspects, the side surfaces 322 and 324 may be angled as shown, and can form a "V" or "U" shape at the top end 320 (or when the separator device 300 is viewed from the top end 320). In some aspects, an entire top end portion of the device can comprise a "V" or "U" cross-sectional shape. In some aspects, an entire top portion of the device can comprise a "V" or "U" cross-sectional shape. The angle x formed between the base surface 314 and the side surface 322 may be between approximately 90° and approximately 170°, in some embodiments between approximately 95° and approximately 170°, in some embodiments between approximately 100° and approximately 145°, and in some embodiments between approximately 110° and approximately 130°. The angle formed between base surface 314 and side surface 224 may be within the same range of angles as for angle x and may be symmetrical and/or asymmetrical with that of angle x. While FIG. 3 illustrates the side surfaces 322 and 324 as planar surfaces, the disclosure herein is not so limited. For example, the side surfaces 322 and 324 may be substantially planar (e.g., flat) and/or curved in a direction along the length of the separator device 300. For example, the side surfaces 322 and 324 may comprise a concave and/or convex (e.g., one or more portions of each side surface 322 and 324 may have differing curves) when view from one or more of the top end 320 and the front surface 312. Thus, each surface 322 and 324 may have one or more portions each with varying radii of curvature or bends/angles as desired for wearer comfort and so to maintain desired space or separation between the breasts of the wearer.

In some embodiments, the separator may comprise a solid material or a perforated material. For example, separator 300 can have a perforated body comprising a plurality of through-holes, collectively referred to as perforations 328. Perforations 328 may facilitate breathability of the wearer while offering the necessary resiliency and compressibility as described herein to maintain separation and shape. A separator device as described herein can comprise any suitable number of perforations of any suitable size and shape.

In some embodiments, separator 300, separator 400, or separator 500 can comprise one or more wings (as further described below, for example, in FIGS. 6-17), which can help keep the separator secured in a desired position when worn with a garment.

The separator devices described herein (e.g., separator 300, separator 400, separator 500, separator 600, separator 700, separator 800, separator 900, separator 1000, separator 1100, separator 1200, separator 1300, separator 1400, separator 1500, separator 1600, separator 1700, separator 1995) can have any suitable size and shape.

For example, a separator device can have a top end portion having a first width (e.g., a maximum width), a bottom end portion having a second width (e.g., a maximum width), and wherein the first width is at least 10% greater than the second width. In some aspects, a base surface portion at the top end portion has a first width (e.g., a maximum width), a front surface portion at the top end portion has a second width (e.g., a maximum width), and the second width is at least 150% the first width. In some aspects, the device has a first thickness at the bottom end portion (e.g., a maximum thickness between the base surface and front surface at the bottom end portion), a second thickness at the top end portion (e.g., a maximum thickness between the base surface and the front surface at the top end portion), and the second thickness is at least 150%, at least 200%, at least 250%, or at least 300% the first thickness. In some aspects, the device can have a third thickness between the first thickness and the second thickness, and the third thickness can be greater than the second thickness. In some aspects, the base surface can comprise a generally trapezoid shape. In some aspects, the base surface can be flat or substantially flat. In some aspects, the front surface can comprise a bottom portion and a top portion, and the bottom portion can comprise an inclined plane, and the entire top portion can be curved. In some aspects, a length from the top end to the bottom end of a separator device is between 1-10 inches, between 2-8 inches, between 3-5 inches, between 3-4.5 inches, or between 3.5-4 inches. In some aspects, the base surface has a varying width from a top end to a bottom end. In some aspects, the varying width includes a first width, a second width, and a third width, and each of the first, second and third width is between 0.5-3.5 inches, or between 0.75 inch and 2 inches (e.g., between 1 inch and 2 inches, between 1 inch and 1.75 inches, or between 1⅛ inch and 1½ inches). In some aspects, the device has a varying thickness (between front surface and base surface), and the largest thickness is between 0.5 and 3.5 inches, between 0.5 and 3 inches, or between 1 inch and 2 inches (e.g., about 1.5 inches), and the smallest thickness is between 0.1 mm and 20 mm (e.g., between 0.1 mm and 10 mm, or between 0.1 mm and 5 mm). In some aspects, a separator device of the disclosure can have a uniform or near-uniform thickness.

As used herein, a "top portion" can be considered a top half of the device, for example, a top third, a top quarter, a top tenth of the device, a portion of the device from the top end to a point between a top quarter and top half, a portion of the device from the top end to a point between a top tenth and top half, wherein "half" refers to halfway along the length of the base surface of the device between top end and bottom end (also referred to herein as a "mid-line"). As used herein, a "bottom portion" can be considered a bottom half of the device, for example, a bottom third, a bottom quarter, a bottom tenth of the device, a portion of the device from the bottom end to a point between a bottom quarter bottom top half, a portion of the device from the bottom end to a point between a bottom tenth and bottom half. As used herein, a "top end portion" of a separator device should be interpreted as the portion of the device comprising the top end and about 10% of the device adjacent the top end. As used herein, a "bottom end portion" of the separator device should be interpreted as the portion of the device comprising the bottom end and about 10% of the device adjacent the bottom end.

Referring now to FIGS. 4A-4E, another embodiment of a separator device 400 is illustrated. Separator device 400 comprises an elongated body having a first surface 412 (referred to herein as a front surface) opposite a second surface 414 (referred to herein as a base surface), both extending from a first end 420 (referred to herein as the top end) opposite a second end 418 (referred to herein as the bottom end). Side surfaces 422 and 424, extending from the top end 420 to the bottom end 418 are provided on opposite sides and between front surface 412 and base surface 414. At the top end 420, the front surface 412 may be spaced apart from the base surface 414 by a first distance (or thickness) where a top end surface is formed between the front surface 412 and the base surface 414 and between side portion 422 and side portion 424. The length of the separator device 400 from the top end 420 to the bottom end 418 can be longer than the length between the side surface 422 to the side surface 424. At the bottom end 418, the front surface 412 may by spaced apart from the base surface 414 by a second distance forming a bottom end surface between the front surface 412 and base surface 414. In some aspects, the second distance (or thickness) of the bottom end can be substantially smaller than the first distance (or thickness) of the top end. For example, the first distance can be at least 200%, at least 300%, at least 400% or at least 500% greater than the second distance.

In some aspects, the bottom end surface can comprise a rectangular surface and the top end surface can comprise a trapezoid surface with a rounded front edge. In some aspects, the base surface can have a varying width across length L3, wherein the width is largest at bottom end 418 and decreases along length L3 with the smallest width at top end 420. In some aspects, the front surface can have a varying width across length L3, wherein the width is largest at or adjacent top end 420 (for example, within 10% of top end 420 with respect to length L3) and smallest at or adjacent bottom end 418 (for example, within 10% of bottom end 418 with respect to length L3). In some aspects, the base surface has a width that generally goes from smallest to largest from top end to bottom end, and front surface has a width that generally goes from largest to smallest from top end to bottom end.

The front surface 412 and base surface 414 can be arranged to form an attachment portion (or attachment member) 416 at or adjacent the bottom end 418. The attachment portion 416 can be shaped to fit (e.g., via a sliding insertion) under a garment (e.g., garment 100 or garment 200, garment 1800, garment 1900), for example, under the band 130 at the bridge 110 running across a torso of the wearer. By inserting the attachment portion 416 under the band 130, and situating the separator device 400 within the cleavage area defined by the breasts, the garment, and the wearer, the separator 400 can at least one of form and maintain a space or separation between the breasts, for example, even when an external pressure (which may have caused the breasts to contact each other without the use of the separator) is applied. In some aspects, the external pressure can come from the garment, which can restrain the separator 400 at the desired location such that the adjustment of the cleavage area is maintained throughout the wearer's daily or evening routines. In the example shown in FIGS. 4A-4E, the second distance between the front surface 412 and the base surface 414 can be very small (e.g., less than 2 cm, less than 1.5 cm, less than 1 cm, less than 9 mm, less than 8 mm, less than 7 mm, less than 6 mm, less than 5 mm). In some aspects, the attachment portion can have a substantially triangular prism shape. In some aspects, the attachment portion can have a substantially triangular prism shape with a bottom end and top end of attachment portion having a rectangular shape. In some aspects, the attachment portion can comprise a bottom portion of the separator device. In some aspects, the attachment portion 416 may be rounded at the bottom end for wearer's comfort. While a triangular prism shape (or substantially triangular prism shape—e.g., one with a truncated or flat bottom end) is illustrated in FIGS. 4A-4E, it should be appreciated that separator devices of the inventive subject matter can comprise any suitable shape, for example, to fit between the garment and a torso of the wearer without causing discomfort. It should also be appreciated that in some aspects, a separator device of the disclosure can lack an attachment portion, for example, where the separator device is sewn onto the garment or placed within a pocket or layers of a garment.

The front surface 412 may have any desired shape, for example, a substantially planar surface or curved surface. For example, the front surface 412 can have a first portion adjacent to the top end 420 with a concave shape and a second portion adjacent the bottom end 418 can have a convex shape. In some aspects, the front surface 412 can have a first portion adjacent to the top end 420 with a convex shape and a second portion adjacent the bottom end 418 can have a concave shape. In some aspects, the front surface 412 may be planar (e.g., substantially flat) and inclined toward the bottom end 418 at an angle relative to the base surface 414, while having a bulging portion adjacent the top end 420. Other curved shapes are possible. Similar to the front surface 412, the base surface 414 may also have any desired shape, for example, a substantially planar shape as illustrated in FIGS. 4A-4E. However, the base surface 414 may also be curved if so desired for wearer's comfort.

In some aspects, the side surfaces 422 and 424 may be angled as shown, and can form a "V" or "U" shape at the top end 420 (or when the separator device 400 is viewed from the top end 420). In some aspects, an entire top end portion of the device can comprise a "V" or "U" cross-sectional shape. In some aspects, an entire top portion of the device can comprise a "V" or "U" cross-sectional shape. The angle formed between the base surface 414 and the side surface 422 may be, for example, in some embodiments between approximately 90° and approximately 170°, in some embodiments between approximately 95° and approximately 170°, in some embodiments between approximately 100° and approximately 145°, and in some embodiments between approximately 110° and approximately 130°. The angle formed between base surface 414 and side surface 424 may be within the same range of angles as between the base surface 414 and side surface 422, and may be symmetrical and/or asymmetrical with that of the angle between base surface 414 and side surface 422. While FIGS. 4A-4E illustrate the side surfaces 422 and 424 as planar surfaces, the disclosure herein is not so limited. For example, the side surfaces 422 and 424 may be substantially planar (e.g., flat) and/or curved in a direction along the length of the separator device 400. For example, the side surfaces 422 and 424 may comprise a concave and/or convex (e.g., one or more portions of each side surface 422 and 424 may have differing curves) when view from one or more of the top end 420 and the front surface 412. Thus, each surface 422 and 424 may have one or more portions each with varying radii of curvature and/or bends/angles as desired for wearer comfort and so to maintain desired space or separation between the breasts of the wearer.

In some aspects, a separator device (e.g., separator device 400) can comprise a first width L1 at a top end that is greater than a second width L2 at the bottom end. While top end 420 has a varying width from front surface to base surface, first width L1 is the portion of top end having the largest width, here, at the front surface. Top end 420 also has a width L5 at the base surface, which can be substantially shorter than first width L1 (e.g., L5 can be between 5-85% of L1, between 5-50% of L1, or between 5-25% of L1). In some embodiments, the bottom end can also have a varying width from front surface to base surface, and second width L2 is the portion of the bottom end having the largest width. In some embodiments, the bottom end has a rectangular shape and a consistent width from front surface to base surface. In some embodiments, the first width L1 can be between 0.75-3 inches, between 0.75-2.5 inches, between 1-2.5 inches, between 1-2 inches, or any other suitable width. The second width L2 can be, for example, between 0.5-2 inches, between 0.5-1.75 inches, between 0.5-1.5 inches, between 1-1.25 inches, or any other suitable width. In some aspects, L1 and L2 can have a L1:L2 ratio of between 5:1-1:5, for example, between 2.5:1 and 1.25:1. In some aspects, the separator device (e.g., separator device 400) can have any suitable thickness, with a greatest thickness L4 towards the top end 420. In some aspects, L4 can be between, for example, 0.5-3 inches, between 0.5-2 inches, or between 1-2 inches. A length between top end 420 and bottom 418 can comprise any suitable length L3, including, for example between 1-5 inches, between 2.5-4 inches, between 3-4.5 inches, or between 3.5-4 inches. In some aspects, L3 and L4 can have a L3:L4 ratio of between 5:1 and 1:5, between 3:1 and 1.25:1, or between 2.75:1 and 2.25:1.

In some embodiments, the separator may comprise a solid material or a perforated material. For example, separator 400 can have a perforated body comprising a plurality of through-holes, collectively referred to as perforations 428. Perforations 428 may facilitate breathability of the wearer while offering the necessary resiliency and compressibility as described herein to maintain separation and shape.

Now turning to FIGS. 5A-5D, another embodiment of a separator device 500 is illustrated.

Separator device 500 comprises an elongated body having a first surface 512 (referred to herein as a front surface) opposite a second surface 514 (referred to herein as a base surface), both extending from a first end 520 (referred to herein as the top end) opposite a second end 518 (referred to herein as the bottom end). Side surfaces 522 and 524, extending from the top end 520 to the bottom end 518 are provided on opposite sides and between front surface 512 and base surface 514. At the top end 520, the front surface 512 may be spaced apart from the base surface 514 by a first distance (or thickness) where a top end surface is formed between the front surface 512 and the base surface 514 and between side portion 522 and side portion 524. The length of the separator device 500 from the top end 520 to the bottom end 518 can be longer than the length between the side surface 522 to the side surface 524. At the bottom end 518, the front surface 512 may by spaced apart from the base surface 514 by a second distance (or thickness), wherein the bottom end surface is formed between the front surface 512 and base surface 514 and between side portion 522 and side portion 524. In some aspects, the second distance (or thickness) of the bottom end can be substantially smaller than the first distance (or thickness) of the top end. For example, the first distance can be at least 200%, at least 300%, at least 400% or at least 500% greater than the second distance.

In some aspects, the bottom end surface can comprise a rectangular surface and the top end surface can comprise a trapezoid with a rounded front edge. In some aspects, the base surface can have a varying width across the length of the separator device 500, wherein the width is largest at bottom end 518 and decreases along the length of the separator device 500 with the smallest width at top end 520. In some aspects, the front surface can have a varying width across the length of separator device 500, wherein the width is largest adjacent top end 520 but not at top end 520 (for example, where the top portion bulges outwards on both sides from top end 520, and wherein the width is largest at a point within, for example, 25% of top end 520 with respect to the length of the device from top end to bottom), and wherein the width is smallest at or adjacent bottom end 418 (for example, at a bottom end portion—i.e., within 10% of bottom end 518 with respect to the length of the separator device from bottom end to top end). In some aspects, the base surface has a width that generally goes from smallest to largest from top end to bottom end, and front surface has a width that is larger at a top portion than at a bottom portion).

The front surface 512 and base surface 514 can be arranged to optionally form an attachment portion (or attachment member) at or adjacent the bottom end 518. The attachment portion can be shaped to fit (e.g., via a sliding insertion) under a garment (e.g., garment 100 or garment 200, garment 1800 or garment 1900), for example, under the band 130 at the bridge 110 running across a torso of the wearer. By inserting the attachment portion under the band 130, and situating the separator device 500 within the cleavage area defined by the breasts, the garment, and the wearer, the separator 500 can at least one of form and maintain a space or separation between the breasts, for example, even when an external pressure (which may have caused the breasts to contact each other without the use of the separator) is applied. In some aspects, the external pressure can come from the garment, which can restrain the separator 500 at the desired location such that the adjustment of the cleavage area is maintained throughout the wearer's daily or evening routines. In the example shown in FIGS. 5A-5D, the second distance between the front surface 512 and the base surface 514 can be very small (e.g., less than 2 cm, less than 1.5 cm, less than 1 cm, less than 9 mm, less than 8 mm, less than 7 mm, less than 6 mm, less than 5 mm). In some aspects, the attachment portion can have a substantially triangular prism shape. In some aspects, the attachment portion can have a substantially triangular prism shape with a bottom end and top end of attachment portion having a rectangular shape. In some aspects, the attachment portion can comprise a bottom portion of the separator device. In some aspects, the attachment portion may be rounded at the bottom end for wearer's comfort. While a triangular prism shape (or substantially triangular prism shape—e.g., one with a truncated or flat bottom end) is illustrated in FIGS. 5A-5D, it should be appreciated that separator devices of the inventive subject matter can comprise any suitable shape, for example, to fit between the garment and a torso of the wearer without causing discomfort. It should also be appreciated that in some aspects, a separator device of the disclosure can lack an attachment portion, for example, where the separator device is sewn onto the garment or placed within a pocket or layers of a garment.

The front surface 512 may have any desired shape, for example, a substantially planar surface or curved surface. For example, the front surface 512 can have a first portion adjacent to the top end 520 with a concave shape and a second portion adjacent the bottom end 518 can have a convex shape. In some aspects, the front surface 512 can have a first portion adjacent to the top end 520 with a convex shape and a second portion adjacent the bottom end 518 can have a concave shape. In some aspects, the front surface 512 may be planar (e.g., substantially flat) and inclined toward the bottom end 518 at an angle relative to the base surface 514, while having a bulging top portion. Other curved shapes are possible. Similar to the front surface 512, the base surface 514 may also have any desired shape, for example, a substantially planar shape as illustrated in FIGS. 5A-5D. However, the base surface 514 may also be curved if so desired for wearer's comfort.

In some aspects, the side surfaces 522 and 524 may be angled as shown, and can form a "V" or "U" shape at the top end 520 (or when the separator device 500 is viewed from the top end 520). The angle y formed between the base surface 514 and the side surface 522 may be, for example, in some embodiments between approximately 90° and approximately 170°, in some embodiments between approximately 95° and approximately 170°, in some embodiments between approximately 100° and approximately 145°, and in some embodiments between approximately 110° and approximately 130°. The angle formed between base surface 514 and side surface 524 may be within the same range of angles as angle y, and may be symmetrical and/or asymmetrical with that of the angle between base surface 514 and side surface 522. While FIGS. 5A-5D illustrate the side surfaces 522 and 524 as planar surfaces, the disclosure herein is not so limited. For example, the side surfaces 522 and 524 may be substantially planar (e.g., flat) and/or curved in a direction along the length of the separator device 500. For example, the side surfaces 522 and 524 may comprise a concave and/or convex (e.g., one or more portions of each side surface 522 and 524 may have differing curves) when view from one or more of the top end 520 and the front surface 512. Thus, each surface 522 and 524 may have one or more portions each with varying radii of curvature as desired for wearer comfort and so to maintain desired space or separation between the breasts of the wearer.

In some aspects, a separator device (e.g., separator device 500) can comprise a largest width of a top portion that is greater than a largest width of the bottom end. In the embodiment shown in FIGS. 5A-5D, the largest width of the top portion is along the front surface 512 and near top end 520. In some aspects, the separator device (e.g., separator device 500) can have any suitable thickness, with a greatest thickness within the top portion. In some aspects, the greatest thickness (or distance between front surface and base surface) can be between, for example, 0.5-3 inches, between 0.5-2 inches, or between 1-2 inches. A length between top end 520 and bottom end 518 can comprise any suitable length, including, for example between 1-5 inches, between 2.5-4 inches, between 3-4.5 inches, or between 3.5-4 inches. In some aspects, the length of the device from top end 520 and bottom end 518 and a greatest thickness of the device can have a ratio of between 5:1 and 1:5, between 3:1 and 1.25:1, or between 2.75:1 and 2.25:1.

In some embodiments, the separator may comprise a solid material or a perforated material. For example, separator 500 can have a perforated body comprising a plurality of through-holes, collectively referred to as perforations 528. Perforations 528 may facilitate breathability of the wearer while offering the necessary resiliency and compressibility as described herein to maintain separation and shape.

Figure 6:
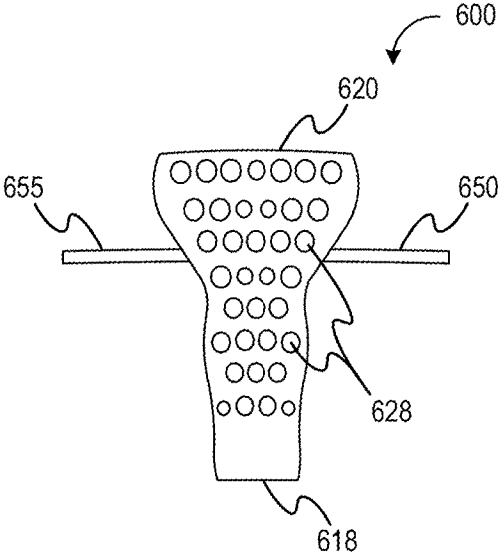
FIG. 6 is a front view of a separator device, according to another embodiment.
Figure 10A:
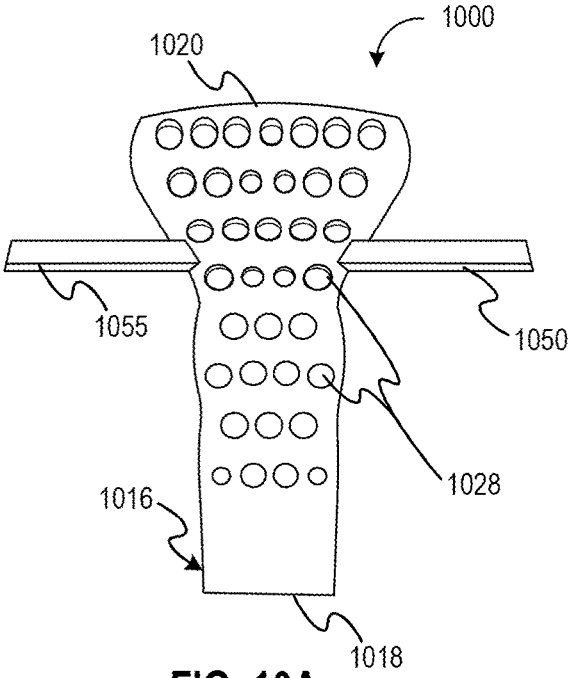
FIG. 10A is a front view of a separator device, according to another embodiment.
Figure 10B:
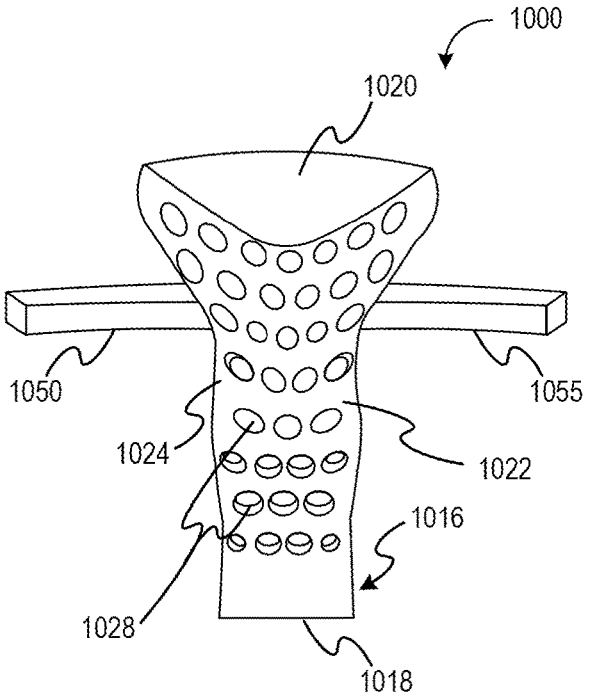
FIG. 10C is a top, front, side perspective of the separator device of FIG. 10A.
FIG. 10D is a top, rear, side perspective view of the separator device of FIG. 10A.
FIG. 10E is a side view of the separator device of FIG. 10A.
FIG. 10F is a top view of the separator device of FIG. 10A.
Figure 10C:
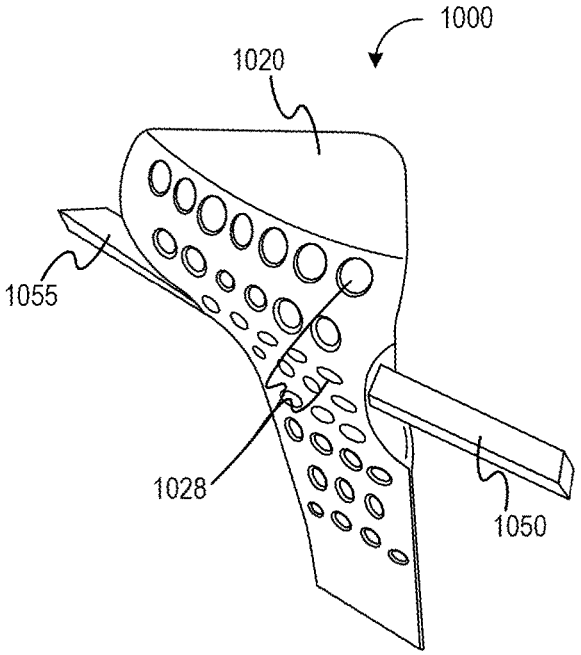
Figure 10D:
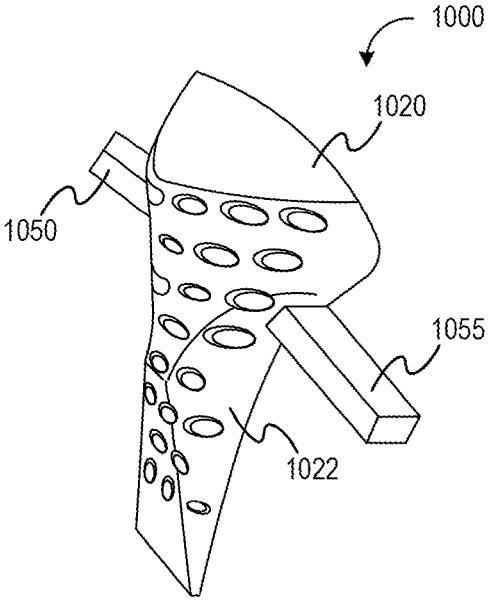
Figure 10E:
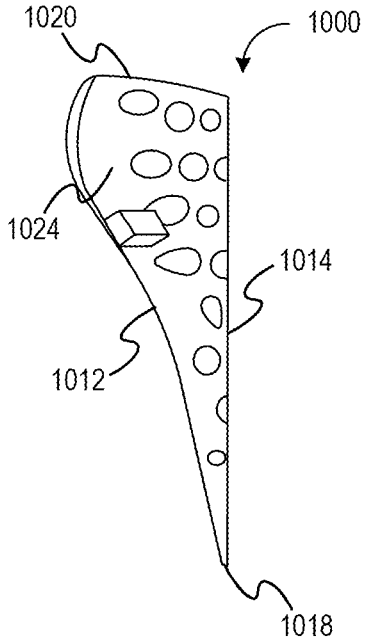
Figure 10F:
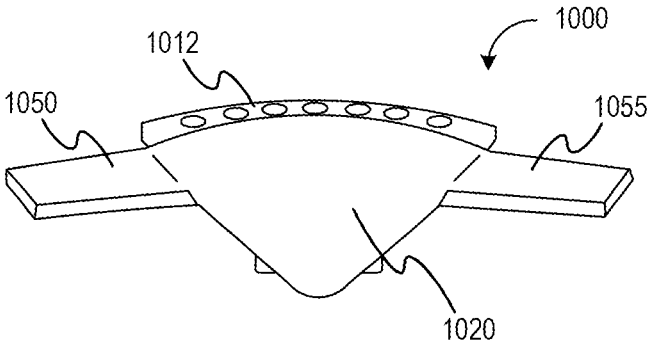
Figure 11A:
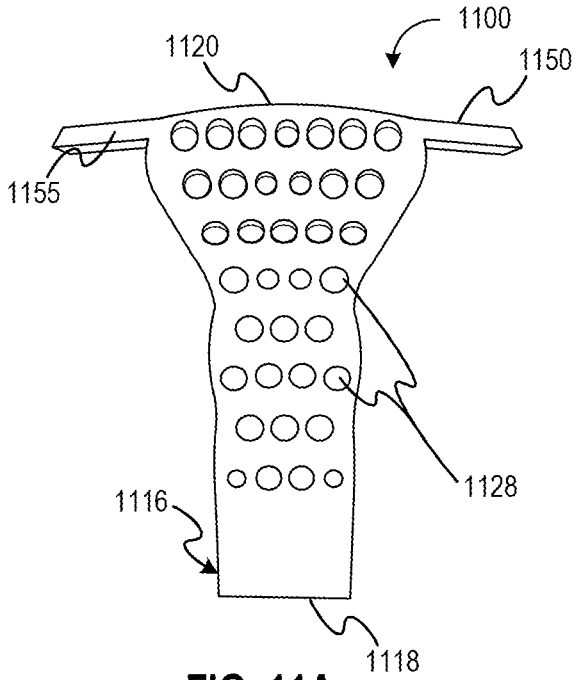
FIG. 11A is a front view of a separator device, according to another embodiment.
Figure 11B:
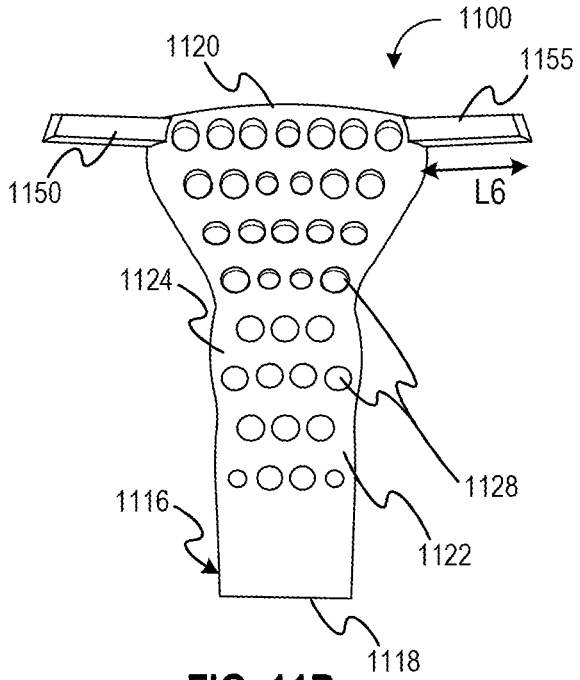
FIG. 11C is a top, front, side perspective of the separator device of FIG. 11A.
FIG. 11D is a top, rear, side perspective view of the separator device of FIG. 11A.
FIG. 11E is a side view of the separator device of FIG. 11A.
Figure 11C:
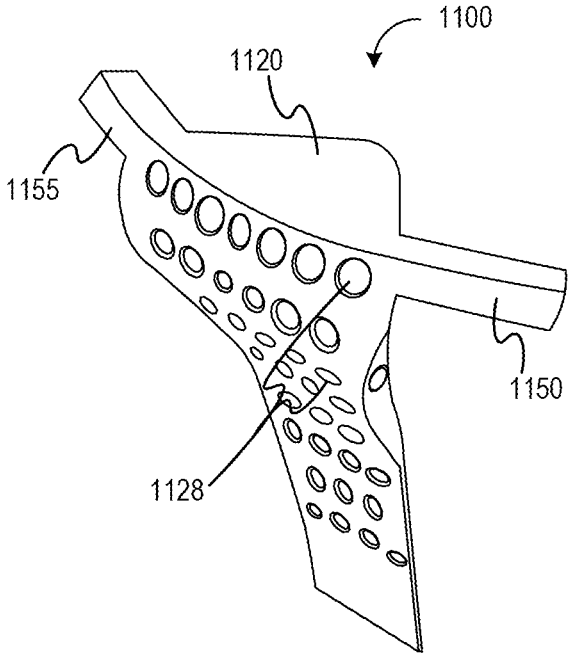
Figure 11D:
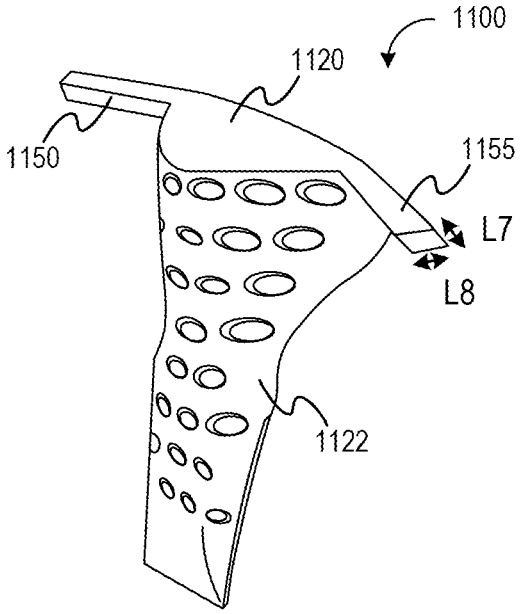
Figure 11E:
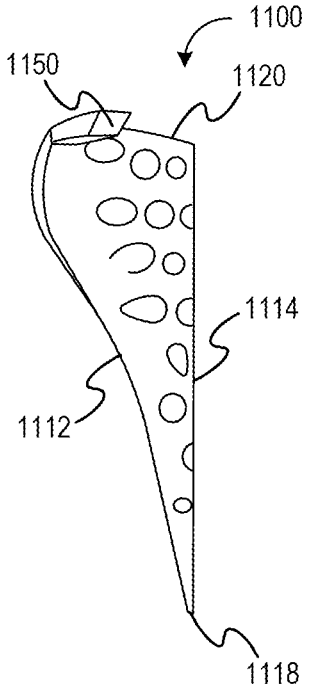

Now turning to FIG. 6, another embodiment of a separator device 600 is illustrated. Separator device 600 comprises an elongated body comprising a first end 620 (referred to herein as a top end), a second end 618 (referred to herein as a bottom end), a first surface (referred to herein as a front surface) opposite a second surface (referred to herein as a base surface, not shown in FIG. 6), both extending from first end 620 to second end 618. Separator device 600 comprises a first wing 655 and a second wing 650, which can advantageously slide underneath a snug portion of a garment, or can be placed through one or more wing receivers on the garment, for example, bands sized and dimensioned to temporarily secure the wings in place. Separator device 600 also comprises a set of openings or perforations 628 for breathability.

Figure 7:
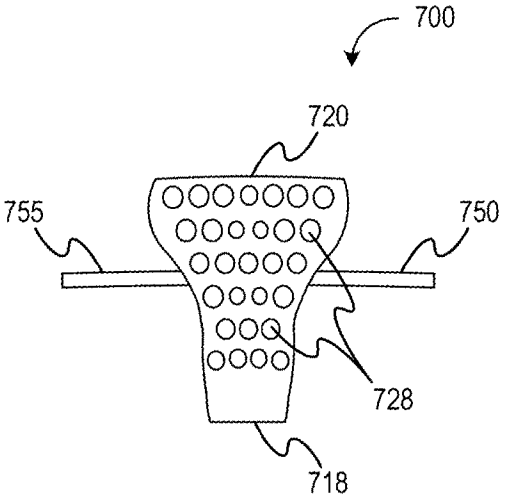
FIG. 7 is a front view of a separator device, according to another embodiment.

Now turning to FIG. 7, another embodiment of a separator device 700 is illustrated. Separator device 700 comprises a body comprising a first end 720 (referred to herein as a top end), a second end 718 (referred to herein as a bottom end), a first surface (referred to herein as a front surface) opposite a second surface (referred to herein as a base surface, not shown in FIG. 7), both extending from first end 720 to second end 718. The elongated body of FIG. 7 has a length from top end 720 to bottom end 718 that is shorter than a length from top end 620 to bottom end 618 of the elongated body of FIG. 6. The length from top end 720 to bottom end 718 can be, for example, between 1-3 inches, between 1.5-2.5 inches, or about 2 inches. The shorter length can be beneficial, for example, when used with a bra, sports bra, shapewear top or other garment that has one or more wing receivers (e.g., bands) incorporated therein (e.g., sewn on or otherwise attached to the garment) that the wings can be secured in, optionally without an attachment portion having to slide under a bra band or other band of a garment. Separator device 700 comprises a first wing 755 and a second wing 750, which can advantageously slide underneath a snug portion of a garment, or can be placed through one or more wing receivers on the garment, for example, bands sized and dimensioned to temporarily secure the wings in place. Separator device 700 also comprises a set of openings or perforations 728 for breathability.

Figure 8:
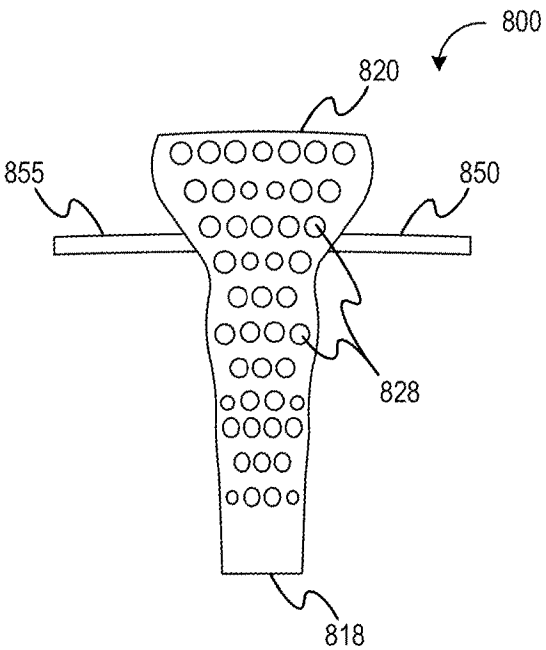
FIG. 8 is a front view of a separator device, according to another embodiment.

Now turning to FIG. 8, another embodiment of a separator device 800 is illustrated. Separator device 800 comprises an elongated body comprising a first end 820 (referred to herein as a top end), a second end 818 (referred to herein as a bottom end), a first surface (referred to herein as a front surface) opposite a second surface (referred to herein as a base surface, not shown in FIG. 8), both extending from first end 820 to second end 818. The elongated body of FIG. 8 has a length from top end 820 to bottom end 818 that is greater than each of a length from top end 620 to bottom end 618 of the elongated body of FIG. 6, and a length from top end 720 to bottom end 718 of the elongated body of FIG. 7 (e.g., at least 5 inches, at least 6 inches, at least 7 inches, at least 8 inches, at least 9 inches. The greater length can be beneficial, for example, to accommodate larger breasts. Separator device 800 comprises a first wing 855 and a second wing 850, which can advantageously slide underneath a snug portion of a garment, or can be placed through one or more wing receivers on the garment, for example, bands sized and dimensioned to temporarily secure the wings in place. Separator device 800 also comprises a set of openings or perforations 828 for breathability.

In FIGS. 6, 7, and 8, there are two wings on each device, and each are placed along a portion of the device other than a top end portion or a bottom end portion of the device (e.g., a mid-portion of the device). However, it should be appreciated that a device can comprise any suitable number of wings, which can be positioned along any suitable portion(s) of the device (e.g., a top end, a top end portion, a bottom end, and/or a bottom end portion), and have any suitable size and shape desired.

Figure 9:
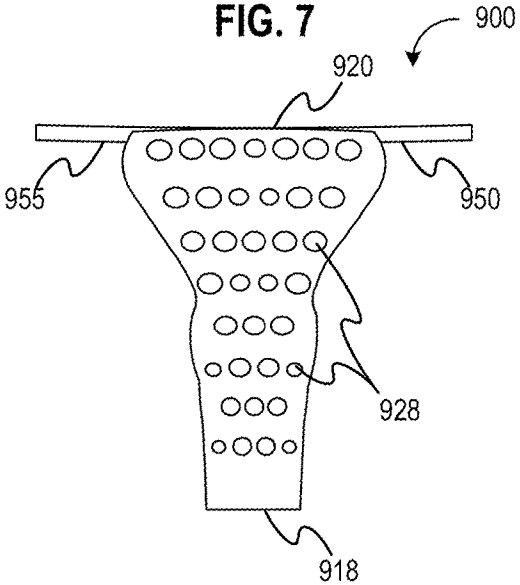
FIG. 9 is a front view of a separator device, according to another embodiment.

Now turning to FIG. 9, another embodiment of a separator device 900 is illustrated. Separator device 900 comprises an elongated body comprising a first end 920 (referred to herein as a top end), a second end 918 (referred to herein as a bottom end), a first surface (referred to herein as a front surface) opposite a second surface (referred to herein as a base surface, not shown in FIG. 9), both extending from first end 920 to second end 918. Separator device 900 comprises a first wing 955 and a second wing 950, which are placed at or adjacent top end 920 of separator device 900 (e.g., at a top end portion of separator device 900). First wing 955 and second wing 950 can advantageously slide underneath a snug portion of a garment, or can be placed through one or more wing receivers on the garment, for example, bands sized and dimensioned to temporarily secure the wings in place. Separator device 900 also comprises a set of openings or perforations 928 for breathability.

Figure 16:
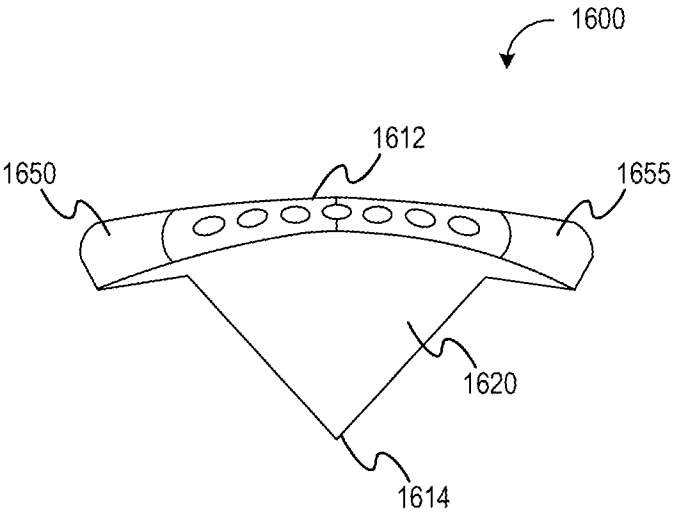
FIG. 16 is a top view of a separator device, according to another embodiment.
Figure 15:
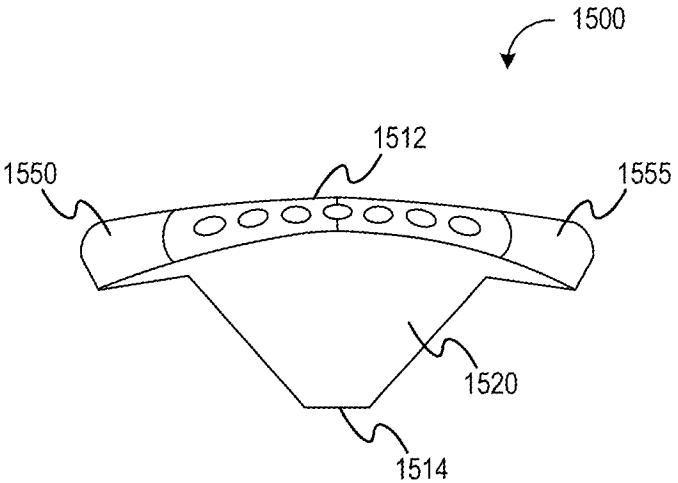
FIG. 15 is a top view of a separator device, according to another embodiment.
Figure 17:
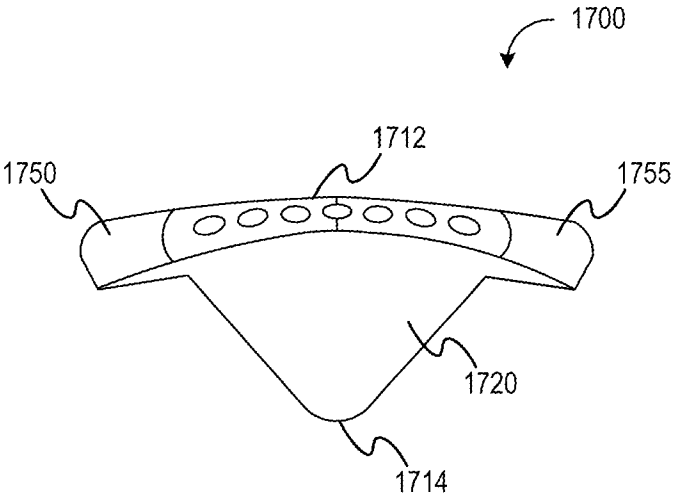
FIG. 17 is a top view of a separator device, according to another embodiment.

Now turning to FIGS. 10A-10F, another embodiment of a separator device 1000 is illustrated. Separator device 1000 comprises an elongated body having a first surface 1012 (referred to herein as a front surface) opposite a second surface 1014 (referred to herein as a base surface). First surface 1012 extends between a first end 1020 (referred to herein as the top end) to an opposite second end 1018 (referred to herein as the bottom end). Second surface 1014 can extend from top end 1020 to bottom end 1018. In some embodiments, a portion of the second surface 1014 can be narrow and be a flat or rounded portion between side surfaces 1022 and 1024 (for example, see 1514 and 1714 as shown in FIGS. 15 and 17, or where a top end forms a dome shape or modified dome shape). In some embodiments, a portion of the second surface 1014 can simply be a point between side surfaces 1022 and 1024 (for example, see 1614 as shown in FIG. 16). At the top end 1020, the front surface 1012 may be spaced apart from the base surface 1014 by a first distance (or thickness) where a top end surface is formed between the front surface 1012 and the base surface 1014 and between side portion 1022 and side portion 1024. The length of the separator device 1000 from the top end 1020 to the bottom end 1018 can be longer than the length between the side surface 1022 to the side surface 1024. At the bottom end 1018, the front surface 1012 may by spaced apart from the base surface 1014 by a second distance (or thickness), wherein the bottom end surface is formed between the front surface 1012 and base surface 1014 and between side portion 1022 and side portion 1024. In some aspects, the second distance (or thickness) of the bottom end can be substantially smaller than the first distance (or thickness) of the top end. For example, the first distance can be at least 200%, at least 300%, at least 400% or at least 500% greater than the second distance.

In some aspects, the bottom end surface can comprise a rectangular surface and the top end surface can comprise a trapezoid shape, a dome shape, a modified trapezoid shape, a modified dome shape (e.g., a dome shape with a bulging base), a triangular shape, a modified triangular shape or a triangular shape with a rounded or bulging front edge and a pointed, rounded or widened rear edge. In some aspects, the base surface can have a varying width across the length of the separator device 1000, wherein the width is largest at bottom end 1018 and decreases along the length of the separator device 1000 with the smallest width at top end 1020. In some embodiments, the base surface can have a varying width across a length of the separator device 1000, wherein the width is largest at bottom end 1018 and decreases along the length of the separator device 1000 to form a triangular shape having a top portion of smallest width portion starting at a mid-portion of the elongated body (e.g., mid-line±20%), and the smallest width portion extending from the mid-portion to the top end 1020. The smallest width portion extending from the mid-portion to the top end 1020 can have the same width across its length, or can have a slightly or greatly varying width. In some embodiments, the base surface can have a varying width across a length of the separator device 1000, and can comprise an hourglass or sideways bat-wing or bow-tie type shape, wherein the width is larger at bottom end 1018 and top end 1020 (relative to a mid-portion), and narrower along a mid-portion. In some aspects, the front surface can have a varying width across the length of separator device 1000 (not including wings), wherein the width is largest at or adjacent top end 1020 and wherein the width is smallest at or adjacent one or both of bottom end 1018 (for example, at a bottom end portion—i.e., within 10% of bottom end 1018 with respect to the length of the separator device from bottom end to top end), and a mid-portion (mid-line±20%). In some aspects, the base surface has a width that generally goes from smallest to largest from top end to bottom end, and front surface has a width that is larger at a top portion than at a bottom portion).

Figure 18:
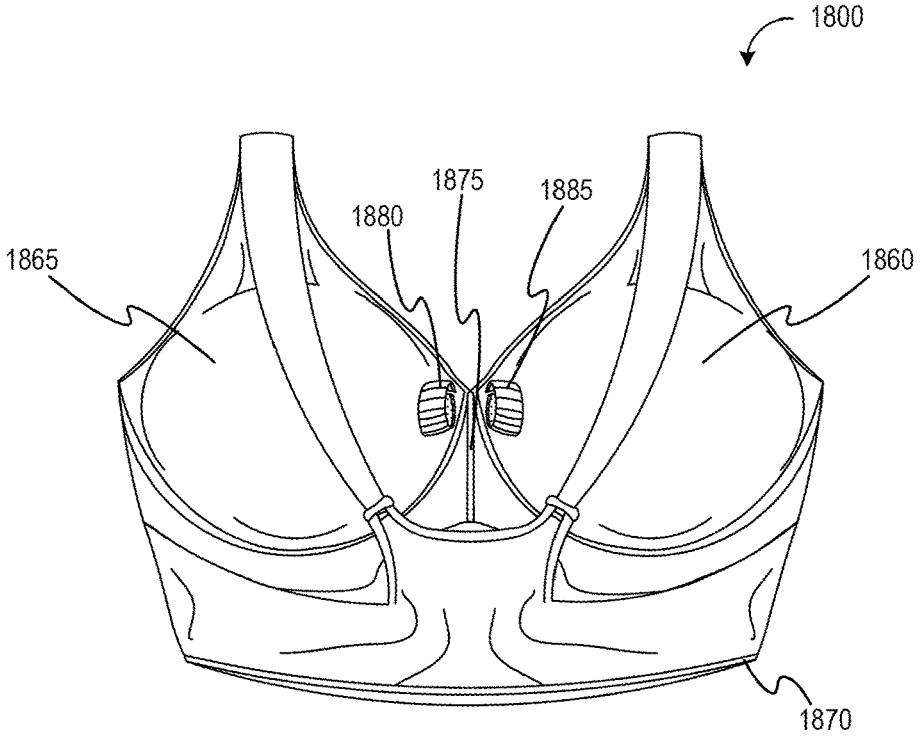
FIG. 18 is a rear view of a bra with separator device receiving bands, according to another embodiment.
Figure 19:
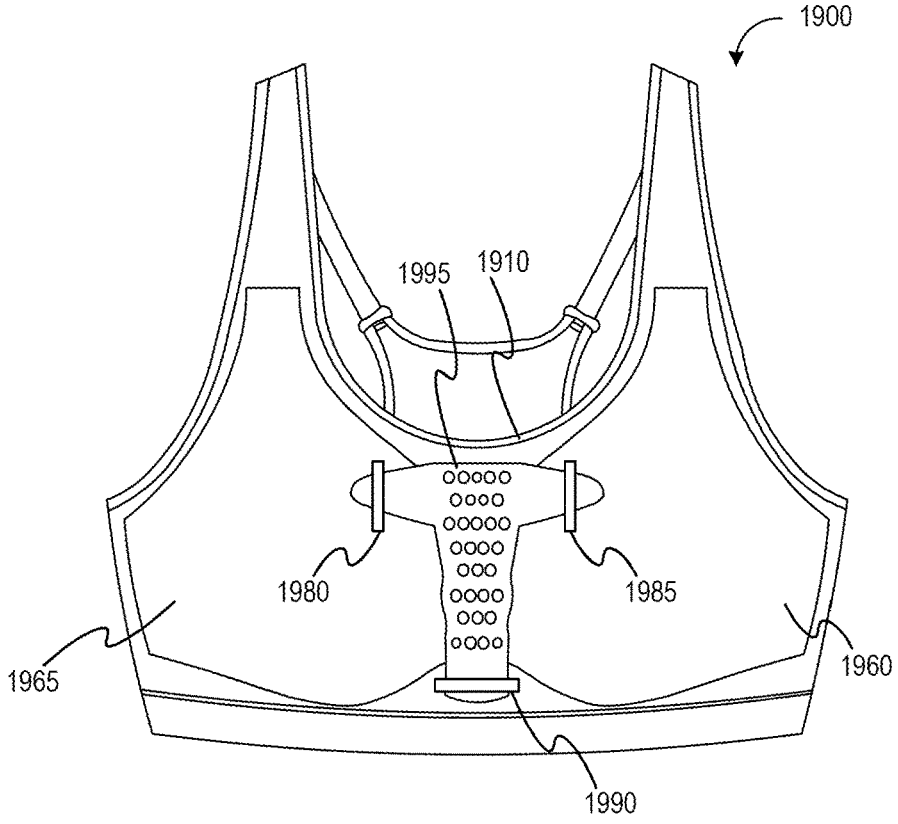
FIG. 19 is a front view of a bra turned inside out with a separator device, according to another embodiment.

The front surface 1012, base surface 1014, and side surfaces 1022 and 1024 can be arranged to optionally form an attachment portion 1016 (or attachment member) at or adjacent the bottom end 1018. The attachment portion can be shaped to fit (e.g., via a sliding insertion) under a garment (e.g., garment 100 or garment 200, garment 1800, garment 1900), for example, under the band 130 at the bridge 110 running across a torso of the wearer. By inserting the attachment portion under the band 130, and situating the separator device 1000 within the cleavage area defined by the breasts, the garment, and the wearer, the separator 1000 can at least one of form and maintain a space or separation between the breasts, for example, even when an external pressure (which may have caused the breasts to contact each other without the use of the separator) is applied. In some aspects, the external pressure can come from the garment, which can restrain the separator 1000 at the desired location such that the adjustment of the cleavage area is maintained throughout the wearer's daily or evening routines. In some aspects, separator device can comprise one, two, three or even more wings. Separator device 1000 comprises first wing 1055 and second wing 1050, each of which have a generally elongated parallelepiped shape, but can comprise any suitable shape. In some embodiments, the wings can be made of the same material(s) as the elongated body. In some embodiments, the wings can be made from different material(s) as the elongated body. In some embodiments, the wings can be straight or curved. Here, wings 1050 and 1055 extend from side surfaces 1022, 1024 at a position between 15-50% down a length from top end 1020 (15-50% down from the top end of a length of device 1000 from top end 1020 to bottom end 1018). In some embodiments, wings 1050 and 1055 can extend from a mid-portion (e.g., mid-line±20%). As best shown in FIGS. 18 and 19, in some embodiments, each wing can be at least one of positioned under a wiring or cup edge of a bra, and through a wing receiver.

It should be appreciated that each wing can be of any suitable material, size and shape, and can be positioned along any portion(s) of a separator device. For example, as shown in FIGS. 11A-11E, in some embodiments a wing of a separator device L6 can comprise a length of between 0.1-5 inches, between 1-3 inches, or any other suitable length, L7 can comprise a width of between 0.1-1 inch, or between ¼ to ½ inch, and L8 can comprise a height of between 0.01-1 inch, or between ¼ to ½ inch.

In the example shown in FIGS. 10A-10F, the second distance between the front surface 1012 and the base surface 1014 can be very small (e.g., less than 2 cm, less than 1.5 cm, less than 1 cm, less than 9 mm, less than 8 mm, less than 7 mm, less than 6 mm, less than 5 mm). In some aspects, the attachment portion can have a substantially triangular prism shape. In some aspects, the attachment portion can have a substantially triangular prism shape with a bottom end and top end of attachment portion having a rectangular shape. In some aspects, the attachment portion can comprise a bottom portion of the separator device. In some aspects, the attachment portion may be rounded at the bottom end for wearer's comfort. While a triangular prism shape (or substantially triangular prism shape—e.g., one with a truncated or flat bottom end) is illustrated in FIGS. 10A-10F, it should be appreciated that separator devices of the inventive subject matter can comprise any suitable shape, for example, to fit between the garment and a torso of the wearer without causing discomfort. It should also be appreciated that in some aspects, a separator device of the disclosure can lack an attachment portion, for example, relying on the device wings.

The front surface 1012 may have any desired shape, for example, a substantially planar surface or curved surface. For example, the front surface 1012 can have a first portion adjacent to the top end 1020 with a concave shape and a second portion adjacent the bottom end 1018 can have a convex shape. In some aspects, the front surface 1012 can have a first portion adjacent to the top end 1020 with a convex shape and a second portion adjacent the bottom end 1018 can have a concave shape. In some aspects, the front surface 1012 may be planar (e.g., substantially flat) and inclined toward the bottom end 1018 at an angle relative to the base surface 1014, while having a bulging top portion. Other curved shapes are possible. Similar to the front surface 1012, the base surface 1014 may also have any desired shape, for example, a substantially planar shape as illustrated in FIGS. 10A-10F. However, the base surface 1014 may also be curved if so desired for wearer's comfort.

In some aspects, the side surfaces 1022 and 1024 may be angled as shown, and can form the arms of a "V" or "U" shape at the top end 1020, for example, a V with a rounded bottom, wherein the rounded bottom comprises a base surface (or when the separator device 1000 is viewed from the top end 1020). An angle formed between side surface 1022 and side surface 1024 at a top end may be, for example, in some embodiments between approximately 50° and approximately 170°, in some embodiments between approximately 70° and approximately 170°, in some embodiments between approximately 75° and approximately 170°, in some embodiments between approximately 85° and approximately 145°, and in some embodiments between approximately 85° and approximately 120°. In the embodiment shown in FIGS. 10A-10F, an angle formed by side surfaces 1022 and 1024 can be considered an angle that would be formed between a first line extending through a first end or edge of side surface 1022 (where side surface 1022 and front surface 1012 meet) and a second end or edge of side surface 1022 (where side surface 1022 meets base surface 1014), and a second line extending through a first end or edge of side surface 1024 (where side surface 1024 and front surface 1012 meet) and a second end or edge of side surface 1024 (where side surface 1024 and base surface 1014 meet). It should be appreciated that the side surfaces or arms of the "V" or "U" shape do not need to be flat or planar. In some embodiments, the side surfaces can have curvatures. At bottom end 1018, side surfaces 1022 and 1024 can be substantially parallel to one another. Side surfaces 1022 and 1024 may have any suitable shape, and can be planar surfaces or curved or bent surfaces. For example, the side surfaces 1022 and 1024 may be substantially planar (e.g., flat), have an irregular shape, and/or be curved in a direction along the length of the separator device 1000. For example, the side surfaces 1022 and 1024 may comprise a concave and/or convex (e.g., one or more portions of each side surface 1022 and 1024 may have differing curves) when view from one or more of the top end 1020, bottom end 1018, and the front surface 1012. Thus, each surface 1022 and 1024 may have one or more portions each with varying radii of curvature as desired for wearer comfort and so to maintain desired space or separation between the breasts of the wearer.

In some aspects, a separator device (e.g., separator device 1000) can comprise a largest width of a top portion that is greater than a largest width of the bottom portion. In the embodiment shown in FIGS. 10A-10F, the largest width of the top portion is along the front surface 1012 and at or near top end 1020. In some aspects, the separator device (e.g., separator device 1000) can have any suitable thickness, with a greatest thickness within the top portion. In some aspects, the greatest thickness (or distance between front surface and base surface) can be between, for example, 0.5-3 inches, between 0.5-2 inches, or between 1-2 inches. A length between top end 1020 and bottom end 1018 can comprise any suitable length, including, for example between 1-8 inches, between 2.5-4 inches, between 3-4.5 inches, between 3.5-4 inches, or between 1-3 inches. In some aspects, the length of the device from top end 1020 and bottom end 1018 and a greatest thickness of the device can have a ratio of between 5:1 and 1:5, between 3:1 and 1.25:1, or between 2.75:1 and 2.25:1.

In some embodiments, the separator may comprise a solid material or a perforated material. For example, separator 1000 can have a perforated body comprising a plurality of through-holes, collectively referred to as perforations 1028. Perforations 1028 may facilitate breathability of the wearer while offering the necessary resiliency and compressibility as described herein to maintain separation and shape.

Now turning to FIGS. 11A-11E, another embodiment of a separator device 1100 is illustrated. Separator device 1100 comprises an elongated body having a first surface 1112 (referred to herein as a front surface) opposite a second surface 1114 (referred to herein as a base surface). First surface 1112 extends between a first end 1120 (referred to herein as the top end) to an opposite second end 1118 (referred to herein as the bottom end). Second surface 1114 can extend from top end 1120 to bottom end 1118. In some embodiments, a portion of the second surface 1114 can be narrow and be a flat or rounded portion between side surfaces 1122 and 1124 (for example, see 1514 and 1714 as shown in FIGS. 15 and 17, or where a base portion top end forms a dome shape or modified dome shape). In some embodiments, a portion of the second surface 1114 can simply be a point between side surfaces 1122 and 1124 (for example, see 1614 as shown in FIG. 16). At the top end 1120, the front surface 1112 may be spaced apart from the base surface 1114 by a first distance (or thickness) where a top end surface is formed between the front surface 1112 and the base surface 1114 and between side portion 1122 and side portion 1124. The length of the separator device 1100 from the top end 1120 to the bottom end 1118 can be longer than the length between the side surface 1122 to the side surface 1124. At the bottom end 1118, the front surface 1112 may by spaced apart from the base surface 1114 by a second distance (or thickness), wherein the bottom end surface is formed between the front surface 1112 and base surface 1114 and between side portion 1122 and side portion 1124. In some aspects, the second distance (or thickness) of the bottom end can be substantially smaller than the first distance (or thickness) of the top end. For example, the first distance can be at least 200%, at least 300%, at least 400% or at least 500% greater than the second distance.

In some aspects, the bottom end surface can comprise a rectangular surface and the top end surface can comprise a trapezoid shape, a dome shape, a modified trapezoid shape, a modified dome shape (e.g., a dome shape with a bulging base), a triangular shape, a circular triangle shape, a modified triangular shape or a triangular shape with a rounded front edge and a rounded or widened rear edge. In some aspects, the base surface can have a varying width across the length of the separator device 1100, wherein the width is largest at bottom end 1118 and decreases along the length of the separator device 1100 with the smallest width at top end 1120. In some embodiments, the base surface can have a varying width across a length of the separator device 1100, wherein the width is largest at bottom end 1118 and decreases along the length of the separator device 1100 to form a triangular shape having a top portion of smallest width portion starting at a mid-portion of the elongated body (e.g., mid-line±20%), and the smallest width portion extending from the mid-portion to the top end 1120. The smallest width portion extending from the mid-portion of the top end 1120 can have the same width across its length, or can have a slightly or greatly varying width. In some embodiments, the base surface can have a varying width across a length of the separator device 1100, and can comprise an hourglass or sideways bat-wing or bow-tie type shape, wherein the width is larger at bottom end 1118 and top end 1120, and narrower along a mid-portion. In some aspects, the front surface can have a varying width across the length of separator device 1100 (not including wings), wherein the width is largest at or adjacent top end 1120 and wherein the width is smallest at or adjacent one or both of bottom end 1118 (for example, at a bottom end portion—i.e., within 10% of bottom end 1118 with respect to the length of the separator device from bottom end to top end), and a mid-portion (mid-line±20%). In some aspects, the base surface has a width that generally goes from smallest to largest from top end to bottom end, and front surface has a width that is larger at a top portion than at a bottom portion).

The front surface 1112, base surface 1114, and side surfaces 1122 and 1124 can be arranged to optionally form an attachment portion 1116 (or attachment member) at or adjacent the bottom end 1118. The attachment portion can be shaped to fit (e.g., via a sliding insertion) under a garment (e.g., garment 100 or garment 200, garment 1800, garment 1900), for example, under the band 130 at the bridge 110 running across a torso of the wearer. By inserting the attachment portion under the band 130, and situating the separator device 1100 within the cleavage area defined by the breasts, the garment, and the wearer, the separator 1100 can at least one of form and maintain a space or separation between the breasts, for example, even when an external pressure (which may have caused the breasts to contact each other without the use of the separator) is applied. In some aspects, the external pressure can come from the garment, which can restrain the separator 1100 at the desired location such that the adjustment of the cleavage area is maintained throughout the wearer's daily or evening routines. In some aspects, separator device can comprise one, two, three or even more wings. Separator device 1100 comprises first wing 1155 and second wing 1150, each of which have a generally elongated parallelepiped shape, but can comprise any suitable shape. In some embodiments, the wings can be made of the same material(s) as the elongated body. In some embodiments, the wings can be made from different material(s) as the elongated body. In some embodiments, the wings can be straight or curved. Here, wings 1150 and 1155 extend from side surfaces 1122, 1124 at or adjacent top end 1120. As best shown in FIGS. 18 and 19, in some embodiments, each wing can be at least one of positioned under a wiring or cup edge of a bra, and through a wing receiver.

In the example shown in FIGS. 11A-11E, the second distance between the front surface 1112 and the base surface 1114 can be very small (e.g., less than 2 cm, less than 1.5 cm, less than 1 cm, less than 9 mm, less than 8 mm, less than 7 mm, less than 6 mm, less than 5 mm). In some aspects, the attachment portion can have a substantially triangular prism shape. In some aspects, the attachment portion can have a substantially triangular prism shape with a bottom end and top end of attachment portion having a rectangular shape. In some aspects, the attachment portion can comprise a bottom portion of the separator device. In some aspects, the attachment portion may be rounded at the bottom end for wearer's comfort. While a triangular prism shape (or substantially triangular prism shape—e.g., one with a truncated or flat bottom end) is illustrated in FIGS. 11A-11E, it should be appreciated that separator devices of the inventive subject matter can comprise any suitable shape, for example, to fit between the garment and a torso of the wearer without causing discomfort. It should also be appreciated that in some aspects, a separator device of the disclosure can lack an attachment portion, for example, relying on the device wings.

The front surface 1112 may have any desired shape, for example, a substantially planar surface or curved surface. For example, the front surface 1112 can have a first portion adjacent to the top end 1120 with a concave shape and a second portion adjacent the bottom end 1118 can have a convex shape. In some aspects, the front surface 1112 can have a first portion adjacent to the top end 1120 with a convex shape and a second portion adjacent the bottom end 1118 can have a concave shape. In some aspects, the front surface 1112 may be planar (e.g., substantially flat) and inclined toward the bottom end 1118 at an angle relative to the base surface 1114, while having a bulging top portion. Other curved shapes are possible. Similar to the front surface 1112, the base surface 1114 may also have any desired shape, for example, a substantially planar shape as illustrated in FIGS. 11A-11E. However, the base surface 1114 may also be curved if so desired for wearer's comfort.

In some aspects, the side surfaces 1122 and 1124 may be angled as shown, and can form the arms of a "V" or "U" shape at the top end 1120, for example, a V with a rounded bottom, wherein the rounded bottom comprises a base surface (or when the separator device 1100 is viewed from the top end 1120). An angle formed between side surface 1122 and side surface 1124 at a top end may be, for example, in some embodiments between approximately 50° and approximately 170°, in some embodiments between approximately 70° and approximately 170°, in some embodiments between approximately 75° and approximately 170°, in some embodiments between approximately 85° and approximately 145°, and in some embodiments between approximately 85° and approximately 120°. In the embodiment shown in FIGS. 11A-11E, an angle formed by side surfaces 1122 and 1124 can be considered an angle that would be formed between a first line extending through a first end or edge of side surface 1122 (where side surface 1122 and front surface 1112 meet) and a second end or edge of side surface 1122 (where side surface 1122 meets base surface 1114), and a second line extending through a first end or edge of side surface 1124 (where side surface 1124 and front surface 1112 meet) and a second end or edge of side surface 1124 (where side surface 1124 and base surface 1114 meet). At bottom end 1118, side surface 1122 and 1124 can be substantially parallel to one another. Side surfaces 1122 and 1124 may have any suitable shape, and can be planar surfaces or curved or bent surfaces. For example, the side surfaces 1122 and 1124 may be substantially planar (e.g., flat), have an irregular shape, and/or be curved in a direction along the length of the separator device 1100. For example, the side surfaces 1122 and 1124 may comprise a concave and/or convex (e.g., one or more portions of each side surface 1122 and 1124 may have differing curves) when view from one or more of the top end 1120, bottom end 1118, and the front surface 1112. Thus, each surface 1122 and 1124 may have one or more portions each with varying radii of curvature as desired for wearer comfort and so to maintain desired space or separation between the breasts of the wearer.

In some aspects, a separator device (e.g., separator device 1100) can comprise a largest width of a top portion that is greater than a largest width of the bottom portion. In the embodiment shown in FIGS. 11A-11E, the largest width of the top portion is along the front surface 1112 and at or near top end 1120. In some aspects, the separator device (e.g., separator device 1100) can have any suitable thickness, with a greatest thickness within the top portion. In some aspects, the greatest thickness (or distance between front surface and base surface) can be between, for example, 0.5-3 inches, between 0.5-2 inches, or between 1-2 inches. A length between top end 1120 and bottom end 1118 can comprise any suitable length, including, for example between 1-8 inches, between 2.5-4 inches, between 3-4.5 inches, between 3.5-4 inches, or between 1-3 inches. In some aspects, the length of the device from top end 1120 and bottom end 1118 and a greatest thickness of the device can have a ratio of between 5:1 and 1:5, between 3:1 and 1.25:1, or between 2.75:1 and 2.25:1.

In some embodiments, the separator may comprise a solid material or a perforated material. For example, separator 1100 can have a perforated body comprising a plurality of through-holes, collectively referred to as perforations 1128. Perforations 1128 may facilitate breathability of the wearer while offering the necessary resiliency and compressibility as described herein to maintain separation and shape.

Now turning to FIGS. 12A-12E, another embodiment of a separator device 1200 is illustrated. Separator device 1200 comprises an elongated body having a first surface 1212 (referred to herein as a front surface) opposite a second surface 1214 (referred to herein as a base surface). First surface 1212 extends between a first end 1220 (referred to herein as the top end) to an opposite second end 1218 (referred to herein as the bottom end). Second surface 1214 can extend from top end 1220 to bottom end 1218. In some embodiments, a portion of the second surface 1214 can be narrow and be a flat or rounded portion between side surfaces 1222 and 1224 (for example, see 1514 and 1714 as shown in FIGS. 15 and 17, or where a top end forms a dome shape or modified dome shape). In some embodiments, a portion of the second surface 1214 can simply be a point between side surfaces 1222 and 1224 (for example, see 1614 as shown in FIG. 16). At the top end 1220, the front surface 1212 may be spaced apart from the base surface 1214 by a first distance (or thickness) where a top end surface is formed between the front surface 1212 and the base surface 1214 and between side portion 1222 and side portion 1224. The length of the separator device 1200 from the top end 1220 to the bottom end 1218 can be longer than the length between the side surface 1222 to the side surface 1224. At the bottom end 1218, the front surface 1212 may by spaced apart from the base surface 1214 by a second distance (or thickness), wherein the bottom end surface is formed between the front surface 1212 and base surface 1214 and between side portion 1222 and side portion 1224. In some aspects, the second distance (or thickness) of the bottom end can be substantially smaller than the first distance (or thickness) of the top end. For example, the first distance can be at least 200%, at least 300%, at least 400% or at least 500% greater than the second distance.

In some aspects, the bottom end surface can comprise a rectangular surface and the top end surface can comprise a trapezoid shape, a dome shape, a modified trapezoid shape, a modified dome shape (e.g., a dome shape with a bulging base), a triangular shape, a modified triangular shape or a triangular shape with a rounded front edge and a rounded or widened rear edge. In some aspects, the base surface can have a varying width across the length of the separator device 1200, wherein the width is largest at bottom end 1218 and decreases along the length of the separator device 1200 with the smallest width at top end 1220. In some embodiments, the base surface can have a varying width across a length of the separator device 1200, wherein the width is largest at bottom end 1218 and decreases along the length of the separator device 1200 to form a triangular shape having a top portion of smallest width portion starting at a mid-portion of the elongated body (e.g., mid-line±20%), and the smallest width portion extending from the mid-portion to the top end 1220. The smallest width portion extending from the mid-portion of the top end 1220 can have the same width across its length, or can have a slightly or greatly varying width. In some embodiments, the base surface can have a varying width across a length of the separator device 1200, and can comprise an hourglass or sideways bat-wing or bow-tie type shape, wherein the width is larger at bottom end 1218 and top end 1220, and narrower along a mid-portion. In some aspects, the front surface can have a varying width across the length of separator device 1200 (not including wings), wherein the width is largest at or adjacent top end 1220 and wherein the width is smallest at or adjacent one or both of bottom end 1218 (for example, at a bottom end portion—i.e., within 10% of bottom end 1218 with respect to the length of the separator device from bottom end to top end), and a mid-portion (mid-line±20%). In some aspects, the base surface has a width that generally goes from smallest to largest from top end to bottom end, and front surface has a width that is larger at a top portion than at a bottom portion).

Figure 12A:
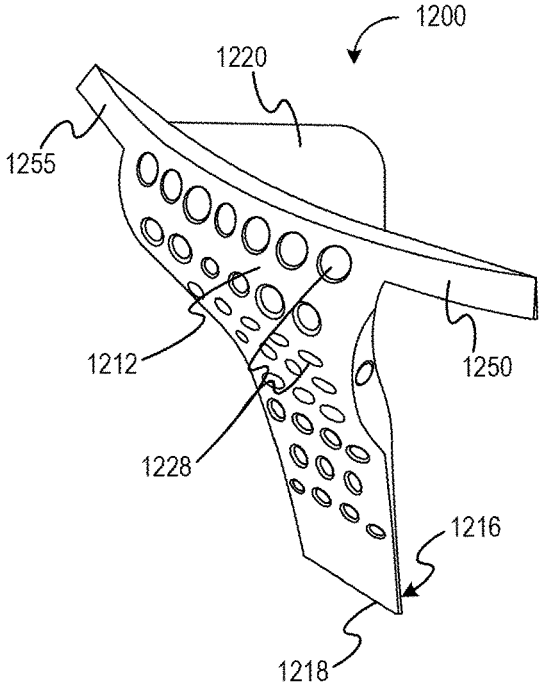
FIG. 12A is a top, front, side perspective view of a separator device, according to another embodiment.
Figure 12B:
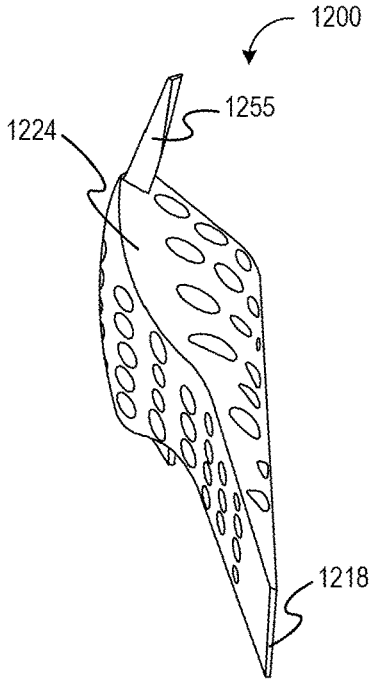
FIG. 12B is a bottom, side, perspective view of the separator device of FIG. 12A.
Figure 12C:
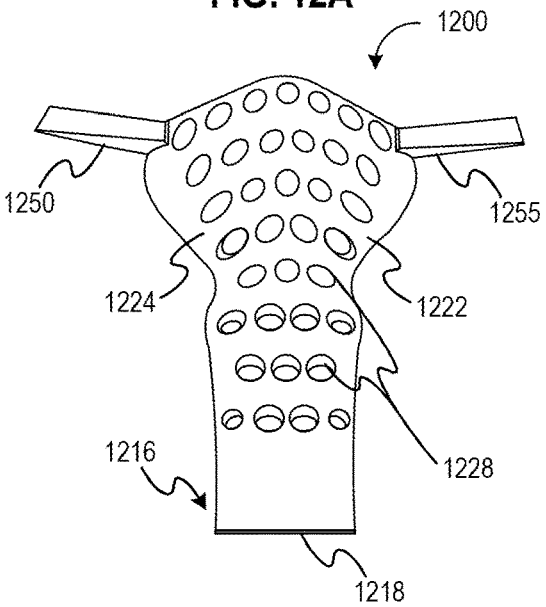
FIG. 12C is a bottom, rear view of the separator device of FIG. 12A.
Figure 12D:
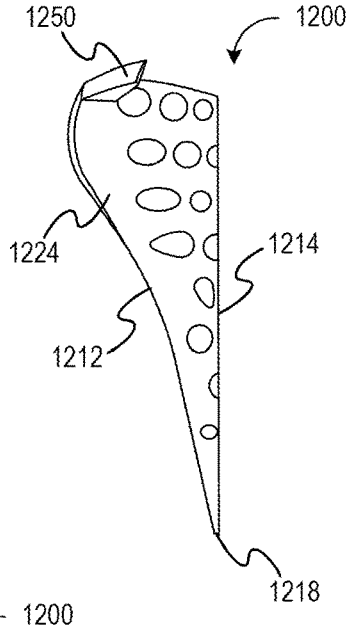
FIG. 12D is a side view of the separator device of FIG. 12A.
Figure 12E:
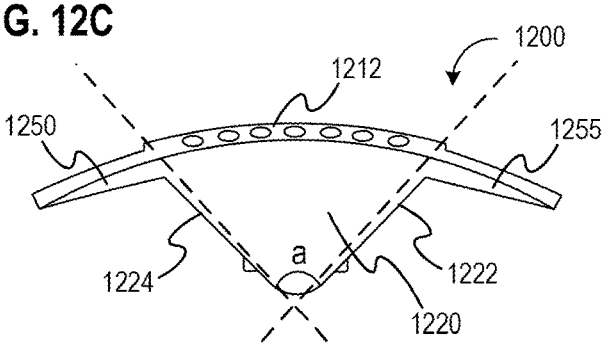
FIG. 12E is a top view of the separator device of FIG. 12A.
Figure 13A:
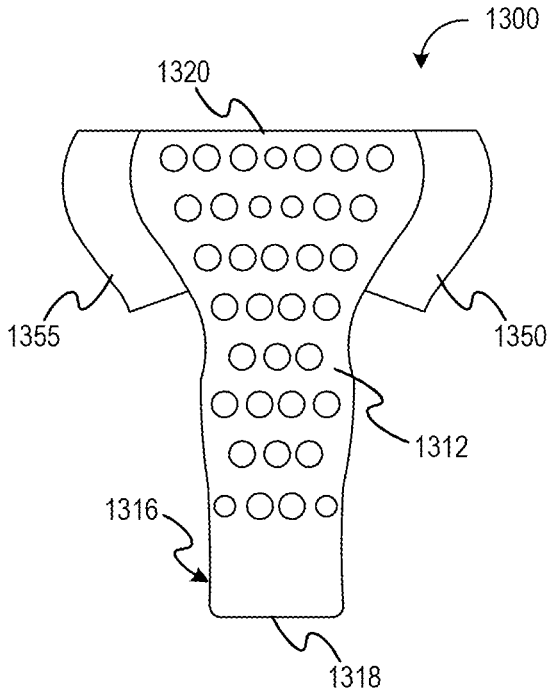
FIG. 13A is a front view of a separator device, according to another embodiment.
Figure 13B:
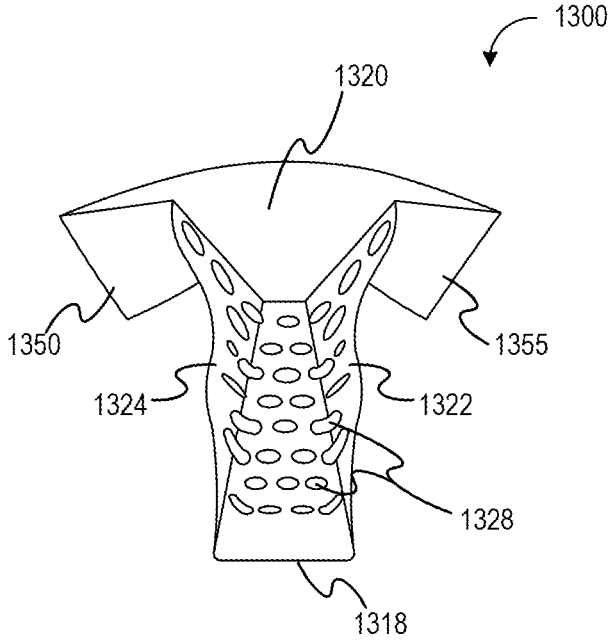
FIG. 13B is a top, rear view of the separator device of FIG. 13A.
Figure 13C:
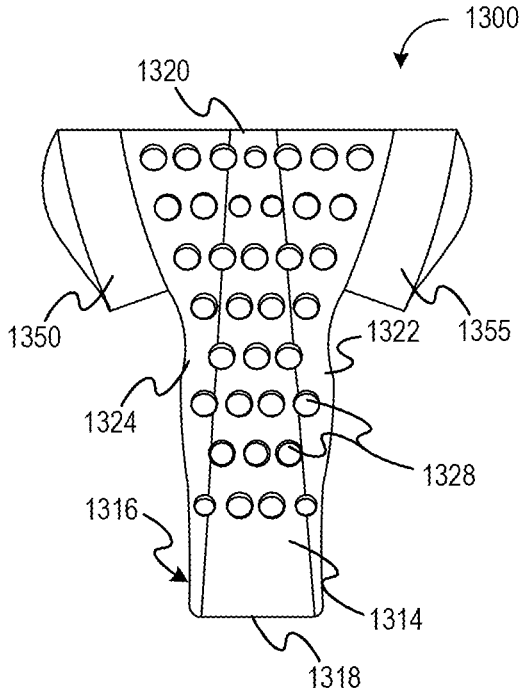
FIG. 13C is a rear view of the separator device of FIG. 13A.
Figure 13D:
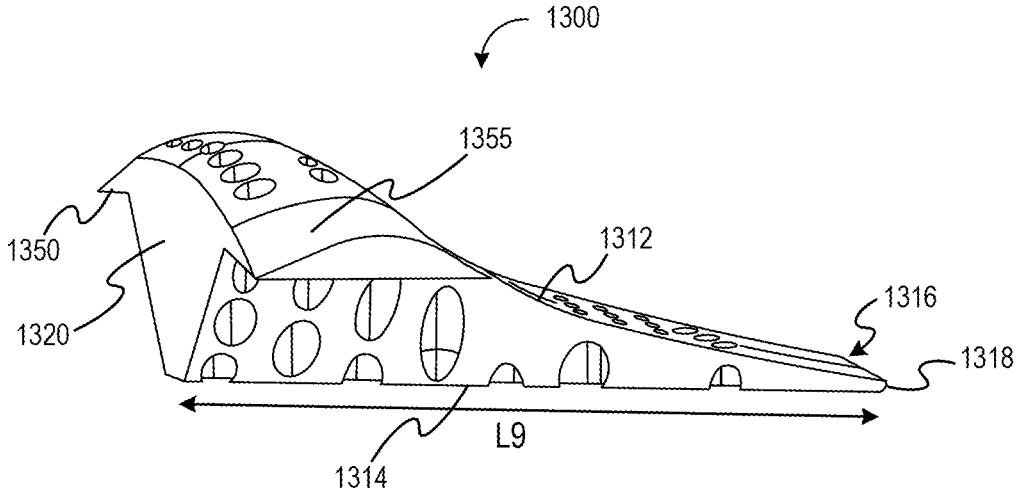
FIG. 13D is a side perspective view of the separator device of FIG. 13A.

The front surface 1212, base surface 1214, and side surfaces 1222 and 1224 can be arranged to optionally form an attachment portion 1216 (or attachment member) at or adjacent the bottom end 1218. The attachment portion can be shaped to fit (e.g., via a sliding insertion) under a garment (e.g., garment 100 or garment 200, garment 1800, garment 1900), for example, under the band 130 at the bridge 120 running across a torso of the wearer. By inserting the attachment portion under the band 130, and situating the separator device 1200 within the cleavage area defined by the breasts, the garment, and the wearer, the separator 1200 can at least one of form and maintain a space or separation between the breasts, for example, even when an external pressure (which may have caused the breasts to contact each other without the use of the separator) is applied. In some aspects, the external pressure can come from the garment, which can restrain the separator 1200 at the desired location such that the adjustment of the cleavage area is maintained throughout the wearer's daily or evening routines. In some aspects, separator device can comprise one, two, three or even more wings. Separator device 1200 comprises first wing 1255 and second wing 1250, each of which have a generally elongated shape that goes from thickest at or adjacent the elongated body and thinnest at its free end (as best seen in FIG. 12E), but can comprise any suitable shape. In some embodiments, the wings can be made of the same material(s) as the elongated body. In some embodiments, the wings can be made from different material(s) as the elongated body. In some embodiments, the wings can be straight or curved. Here, wings 1250 and 1255 extend from side surfaces 1222, 1224 at or adjacent top end 1220. As best shown in FIGS. 18 and 19, in some embodiments, each wing can be at least one of positioned under a wiring or cup edge of a bra, and through a wing receiver.

In the example shown in FIGS. 12A-12E, the second distance between the front surface 1212 and the base surface 1214 can be very small (e.g., less than 2 cm, less than 1.5 cm, less than 1 cm, less than 9 mm, less than 8 mm, less than 7 mm, less than 6 mm, less than 5 mm). In some aspects, the attachment portion can have a substantially triangular prism shape. In some aspects, the attachment portion can have a substantially triangular prism shape with a bottom end and top end of attachment portion having a rectangular shape. In some aspects, the attachment portion can comprise a bottom portion of the separator device. In some aspects, the attachment portion may be rounded at the bottom end for wearer's comfort. While a triangular prism shape (or substantially triangular prism shape—e.g., one with a truncated or flat bottom end) is illustrated in FIGS. 12A-12E, it should be appreciated that separator devices of the inventive subject matter can comprise any suitable shape, for example, to fit between the garment and a torso of the wearer without causing discomfort. It should also be appreciated that in some aspects, a separator device of the disclosure can lack an attachment portion, for example, relying on the device wings.

The front surface 1212 may have any desired shape, for example, a substantially planar surface or curved surface. For example, the front surface 1212 can have a first portion adjacent to the top end 1220 with a concave shape and a second portion adjacent the bottom end 1218 can have a convex shape. In some aspects, the front surface 1212 can have a first portion adjacent to the top end 1220 with a convex shape and a second portion adjacent the bottom end 1218 can have a concave shape. In some aspects, the front surface 1212 may be planar (e.g., substantially flat) and inclined toward the bottom end 1218 at an angle relative to the base surface 1214, while having a bulging top portion. Other curved shapes are possible. Similar to the front surface 1212, the base surface 1214 may also have any desired shape, for example, a substantially planar shape as illustrated in FIGS. 12A-12E. However, the base surface 1214 may also be curved if so desired for wearer's comfort.

In some aspects, the side surfaces 1222 and 1224 may be angled as shown, and can form the arms of a "V" or "U" shape at the top end 1220, for example, a V with a rounded bottom, wherein the rounded bottom comprises a base surface (or when the separator device 1200 is viewed from the top end 1220). An angle formed between side surface 1222 and side surface 1224 at a top end may be, for example, in some embodiments between approximately 50° and approximately 170°, in some embodiments between approximately 70° and approximately 170°, in some embodiments between approximately 75° and approximately 170°, in some embodiments between approximately 85° and approximately 145°, and in some embodiments between approximately 85° and approximately 120°. In the embodiment shown in FIGS. 12A-12E, an angle formed by side surfaces 1222 and 1224 (angle a as shown in FIG. 12E) can be considered an angle that would be formed between a first line extending through a first end or edge of side surface 1222 (where side surface 1222 and front surface 1212 meet) and a second end or edge of side surface 1222 (where side surface 1222 meets base surface 1214), and a second line extending through a first end or edge of side surface 1224 (where side surface 1224 and front surface 1212 meet) and a second end or edge of side surface 1224 (where side surface 1224 and base surface 1214 meet). For example, see dashed lines in FIG. 12E as example first and second lines forming angle a. At bottom end 1218, side surface 1222 and 1224 can be substantially parallel to one another. Side surfaces 1222 and 1224 may have any suitable shape, and can be planar surfaces or curved or bent surfaces. For example, the side surfaces 1222 and 1224 may be substantially planar (e.g., flat), have an irregular shape, and/or be curved in a direction along the length of the separator device 1200. In some embodiments, it is contemplated that one or multiple side portions (e.g., at least 1 side portion, at least 2 side portions, at least 3 side portions) can be provided on each side of the device. For example, the side surfaces 1222 and 1224 may comprise a concave and/or convex (e.g., one or more portions of each side surface 1222 and 1224 may have differing curves) when view from one or more of the top end 1220, bottom end 1218, and the front surface 1212. Thus, each surface 1222 and 1224 may have one or more portions each with varying radii of curvature as desired for wearer comfort and so to maintain desired space or separation between the breasts of the wearer.

In some aspects, a separator device (e.g., separator device 1200) can comprise a largest width of a top portion that is greater than a largest width of the bottom portion. In the embodiment shown in FIGS. 12A-12E, the largest width of the top portion is along the front surface 1212 and at or near top end 1220. In some aspects, the separator device (e.g., separator device 1200) can have any suitable thickness, with a greatest thickness within the top portion. In some aspects, the greatest thickness (or distance between front surface and base surface) can be between, for example, 0.5-3 inches, between 0.5-2 inches, or between 1-2 inches. A length between top end 1220 and bottom end 1218 can comprise any suitable length, including, for example between 1-8 inches, between 2.5-4 inches, between 3-4.5 inches, between 3.5-4 inches, or between 1-3 inches. In some aspects, the length of the device from top end 1220 and bottom end 1218 and a greatest thickness of the device can have a ratio of between 5:1 and 1:5, between 3:1 and 1.25:1, or between 2.75:1 and 2.25:1.

In some embodiments, the separator may comprise a solid material or a perforated material. For example, separator 1200 can have a perforated body comprising a plurality of through-holes, collectively referred to as perforations 1228. Perforations 1228 may facilitate breathability of the wearer while offering the necessary resiliency and compressibility as described herein to maintain separation and shape.

Now turning to FIGS. 13A-13D, another embodiment of a separator device 1300 is illustrated. Separator device 1300 comprises an elongated body having a front surface 1312, a base surface 1314, a top end 1320, a bottom end 1318 that is slightly rounded on the sides, an attachment portion 1316, a first side surface 1322 extending between front surface 1312, base surface 1314, top end 1320, and bottom end 1318, and a second side surface 1324 opposite first side surface 1322, extending between front surface 1312, base surface 1314, top end 1320, and bottom end 1318. Separator device 1300 further comprises a set of openings 1328, and first and second wings 1350 and 1355, respectively. First and second wings 1350 and 1355 each have a thickness that can taper from a thickness of between 0.5-0.8 inches at a first end to 0.01-0.3 at a second end. However, it should be appreciated that first and second wings 1350 and 1355 can have any suitable size and shape. Here, each of first and second wings 1350 and 1355 have a length (in the direction of L9) that is between 10-50%, between 20-40%, or between 25-35% of length L9. A length of elongated device can comprise any suitable length L7, including for example, at least 1 inch, at least 2 inches, at least 3 inches, at least 5 inches, at least 7 inches, at least 8 inches, or between 2-8 inches.

Figure 14A:
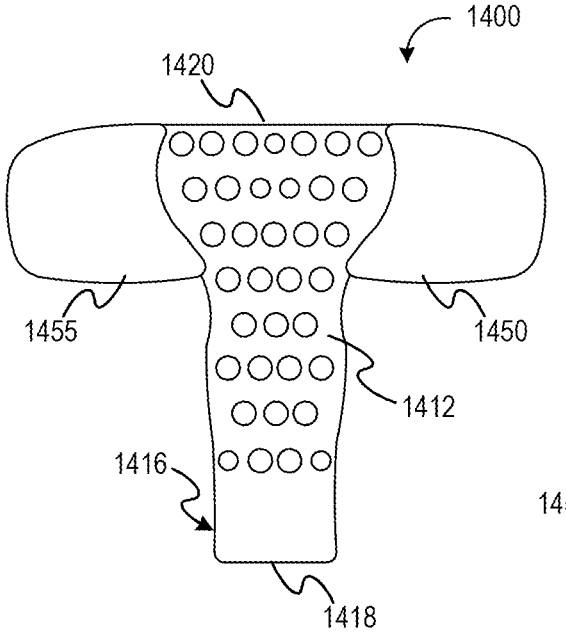
FIG. 14A is a front view of a separator device, according to another embodiment.
Figure 14B:
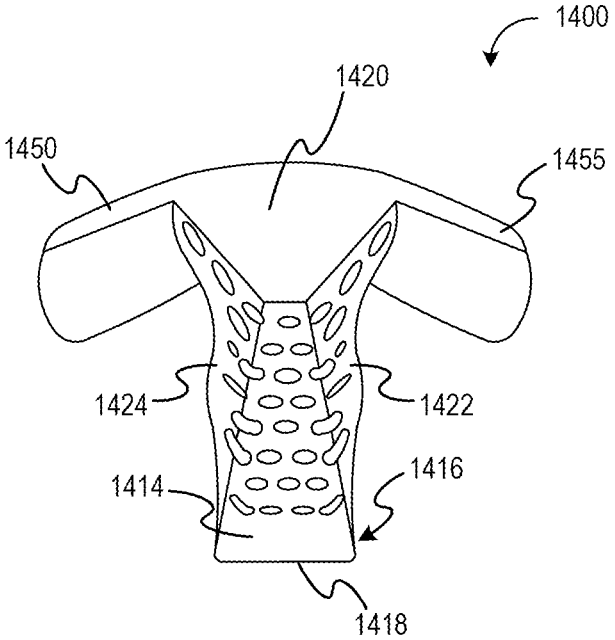
FIG. 14B is a top, rear view of the separator device of FIG. 14A.

Now turning to FIGS. 14A-14B, another embodiment of a separator device 1400 is illustrated. Separator device 1400 comprises an elongated body having a front surface 1412, a base surface 1414, a top end 1420, a bottom end 1418 that is slightly rounded on the sides, an attachment portion 1416, a first side surface 1422 extending between front surface 1412, a trapezoidal base surface 1414, top end 1420, and bottom end 1418, and a second side surface 1424 opposite first side surface 1422, extending between front surface 1412, base surface 1414, top end 1420, and bottom end 1418. Separator device 1400 further comprises a set of openings 1428, and first and second wings 1450 and 1455, respectively. First and second wings 1450 and 1455 are "squared" wings having rounded edges, and have a thickness that tapers and is narrowest at the free ends.

Now turning to FIGS. 15, 16, and 17, different embodiments of separator devices are illustrated having different base surface shapes when viewing top ends of the devices. Separator device 1500 comprises a top end 1520, a front surface 1512, a base surface 1514, and optionally a first wing 1550, and a second wing 1555. Here, wings 1550 and 1555 extend out and to the sides from top end 1520. Base surface 1514 is flat or substantially flat at top end 1520. Separator device 1600 comprises a top end 1620, a front surface 1612, a base surface 1615, and optionally a first wing 1650, and a second wing 1655. Base surface 1614 is a pointed juncture where side surfaces of the device meet at top end 1620. Such a V shaped base surface can allow for deeper and more snug fit between breasts, helping it stay in place better, and fitting more comfortably and deeper in cleavage. Separator device 1700 comprises a top end 1720, a front surface 1712, a base surface 1715, and optionally a first wing 1750, and a second wing 1755. Base surface 1714 is a narrow rounded portion between side surfaces of the device at top end 1720. The U shaped base surface can also allow for deeper and more snug fit between breasts, helping it stay in place better, and fitting more comfortably and deeper in cleavage.

Now turning to FIG. 18, a garment 1800 (here, a bra) is illustrated having cup 1860, cup 1865, bridge 1875 between cups 1860 and 1865, and a band 1870 extending beneath cups 1860 and 1865 and configured to wrap around a chest or torso area of a wearer. In the embodiment shown, two wing receivers 1880 and 1885 are illustrated. Here, wing receivers 1880 and 1885 comprise bands of material (e.g., elastic or inelastic material(s)) that are sewn or otherwise affixed to the inside surface of garment 1800. Wing receivers 1880 and 1885 can be affixed to inner edges of cups 1860 and 1865 adjacent bridge 1875, as shown in FIG. 18, or can be affixed to any other portion(s) of garment 1800. While only two wing receivers are shown in FIG. 18, it is contemplated that a garment can comprise any suitable number of receivers to accommodate any suitable number of wings, attachment portions, or other portions of any suitable number of separator devices. For example, FIG. 19 illustrates a garment 1900 (shown inside out), having a front portion 1910 including a first cup 1960, a second cup 1965, and three receivers 1980, 1985, and 1990. Receivers 1980 and 1985 are wing receivers sized and dimensioned to receive and secure first and second wings of separator device 1995. Receiver 1990 is sized and dimensioned to receive and secure an attachment portion of separator device 1995. Receivers of the disclosure can be made of any suitable material and comprise any size and shape. For example, a receiver can comprise an elastic band made of a woven polyester fabric, a fiber rubber, an elastic material, a Lycra, a spandex, an elastane, a cotton, a polyester, or a combination thereof, and having a diameter that is between 1-5 cm, 1-3 cm, 1-2 cm, or between 0.1 and 1.25 cm. In some embodiments, for example, where the receiver is elastic, a diameter of the receiver can be less than 95%, less than 90%, or less than 80% of a length (e.g., L7 of FIG. 11) of a wing to be positioned therethrough. In some embodiments, for example, where the receiver is inelastic, a diameter of the receiver can be at least 100%, at least 110%, or at least 120% of a length (e.g., L7 of FIG. 11) of a wing to be positioned therethrough. As another example, a receiver an comprise strap that is made of any suitable material (e.g., a woven polyester fabric, a fiber rubber, an elastic material, a Lycra, a spandex, an elastane, a cotton, a polyester, or a combination thereof) with first and second ends sewn to the garment's inner surface to form a loop, and having a length that is between 1-5 cm, 1-3 cm, 1-2 cm, or between 0.1 and 1.25 cm. In some embodiments, for example, where the receiver is elastic, a length of the receiver can be less than 95%, less than 90%, or less than 80% of a length (e.g., L7 of FIG. 11) of a wing to be positioned therethrough. In some embodiments, for example, where the receiver is inelastic, a length of the receiver can be at least 100%, at least 110%, or at least 120% of a length (e.g., L7 of FIG. 11) of a wing to be positioned therethrough. In some embodiments, a receiver can comprise a pocket with one or more slits sized and dimensioned to receive a portion of a wing. In some embodiments, the receiver can be made of the same material(s) as the garment it is coupled to. In some embodiments, the receiver can be made of a different material than the garment it is coupled to.

The separator devices described herein (e.g., separator 300, separator 400, separator 500, separator 600, separator, 700, separator 800, separator 900, separator 1000, separator 1100, separator 1200, separator 1300, separator 1400, separator 1500, separator 1600, separator 1700, separator 1995) may be made of any suitable material, including, for example, any material(s) that provides sufficient stiffness to maintain space or separation, while offering sufficient pliability to be comfortable to the wearer (e.g., to conform to the wearer's chest). For example, the separator be formed of a material offering resiliency such that the separator maintains structural integrity to maintain space and/or separation, while also conforming somewhat to the breasts when brought into contact with surfaces of the breasts. In some aspects, where the base surface is configured to be placed against the wearer's body between the wearer's breasts, the separator can be sufficiently pliable such that an entire base surface contacts the area between the breasts. The selected material(s) can advantageously have the resiliency and compressibility to offer suppleness that is similar to that of breast tissue, making the presence of the separator almost unnoticeable by the wearer. Example materials include, but are not limited to, silicone material, rubber, memory foam, etc. The material(s) can be selected to achieve desired properties and may be varied to accommodate different breast sizes. For example, larger breast with more weight may require a material with higher resiliency to maintain shape and separation, while placement of smaller breasts may be sufficiently maintained by less resilient materials. Furthermore, material(s) (e.g., silicone) can be selected for certain properties such as being sweat resistant, bacteria resistant, odor free, waterproof, hypoallergenic, skin friendly, etc.

The separator devices described herein (e.g., separator 300, separator 400, separator 500, separator 600, separator, 700, separator 800, separator 900, separator 1000, separator 1100, separator 1200, separator 1300, separator 1400, separator 1500, separator 1600, separator 1700, separator 1995) can be clear (colorless), or can be of any suitable color or colors, including for example, a skin tone. In some aspects, the separator devices can be transparent, semi-transparent, or opaque. The dimensions of the separator device may be varied to accommodate different breast sizes and cleavage depth and width. Thus, a separator having larger dimensions may be configured to use with larger breasts and/or larger cleavage depth/area and smaller dimensioned separators may be configured for use with smaller breasts. The length, width, and/or thickness of separator may be varied as desired to accommodate these variances.

While some embodiments of the separator devices disclosed herein are described as being configured to be slidably inserted between the bridge of a garment and the wearer, other approaches are possible. For example, a separator device may be affixed to a garment as by any desired means in a permanent or removable manner. For example, adhesive may be applied to the garment separator such that the separator is affixed thereto; fasteners such as buttons, straps, laces, magnets, pocket etc. may be employed to removably affix the separator to a garment; the separator may be sewed into the garment or otherwise formed into the garment as an integrated part thereof (e.g., positioned between two layers).

Thus, specific examples of separator devices have been disclosed. The above description of the disclosed embodiments is provided to enable any person skilled in the art to make or use the invention. Various modifications to these embodiments will be readily apparent to those skilled in the art, and the general principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

As used herein and in the appended claims, the singular forms "a," "an," and "the" include plural referents unless the context clearly dictates otherwise. It is further noted that the claims can be drafted to exclude any optional element. As such, this statement is intended to serve as antecedent basis for use of such exclusive terminology as "solely," "only" and the like in connection with the recitation of claim elements, or use of a "negative" limitation.

Reference throughout this specification to "an embodiment" or "an implementation" means that a particular feature, structure, or characteristic described in connection with the embodiment is included in at least one embodiment or implementation. Thus, appearances of the phrases "in an embodiment" in various places throughout this specification are not necessarily all referring to the same embodiment or a single exclusive embodiment. Furthermore, the particular features, structures, or characteristics described herein may be combined in any suitable manner in one or more embodiments or one or more implementations.

The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Certain numerical values and ranges are presented herein with numerical values being preceded by the term "about." The term "about" is used herein to provide literal support for the exact number that it precedes, as well as a number that is near to or approximately the number that the term precedes. In determining whether a number is near to or approximately a specifically recited number, the near or approximating un-recited number may be a number which, in the context in which it is presented, provides the substantial equivalent of the specifically recited number.

Combinations, described herein, such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, and any such combination may contain one or more members of its constituents A, B, and/or C. For example, a combination of A and B may comprise one A and multiple B's, multiple A's and one B, or multiple A's and multiple B's.

All structural and functional equivalents to the components of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A breast separator device for a wearer having a cleavage area between a first breast and a second breast, the breast separator device comprising:

an elongated body comprising a base surface, a front surface, a top end, a bottom end, a first side surface extending between the top end and the bottom end, and between the base surface and the front surface on a first side, and a second side surface extending between the top end and the bottom end, and between the base surface and the front surface on a second side;

at least one wing extending outward from the elongated body;

wherein the first side surface and second side surface form an angle of between 50-170 degrees at the top end;

wherein the elongated body has a first thickness at the top end that is greater than a second thickness at the bottom end; and wherein the elongated body, when placed within the cleavage area between the first breast and the second breast, is configured to maintain a separation between the first breast and the second breast in the cleavage area.

2. The breast separator device of claim 1, wherein the separator device is made at least in part of a silicone.

3. The breast separator device of claim 1, further comprising a plurality of openings extending from the front surface to at least one of the base surface, the first side surface, and the second side surface.

4. The breast separator device of claim 1, wherein the at least one wing comprises a first wing and a second wing, wherein the first wing extends outward from the first side surface, and wherein the second wing extends outward from the second side surface.

5. The breast separator device of claim 1, wherein a base surface portion at a top end portion has a first width, wherein a front surface portion at the top end portion has a second width, and wherein the second width is at least 120% the first width.

6. The breast separator device of claim 1, wherein the first side surface and the second side surface are parallel at the bottom end.

7. The breast separator device of claim 1, wherein the base surface has a first portion comprising a triangular shape.

8. The breast separator device of claim 1, wherein the base surface has a trapezoid shape.

9. The breast separator device of claim 1, wherein the base surface is substantially flat, and wherein the device is made at least in part of a sweat resistant material.

10. The breast separator device of claim 1, wherein the front surface has a bottom portion and a top portion, wherein the bottom portion comprises an inclined plane, and wherein the entire top portion is curved.

11. The breast separator device of claim 1, wherein the device has a non-uniform thickness.

12. The breast separator device of claim 1, wherein a length from the top end to the bottom end is between 1.5-8 inches.

13. The breast separator device of claim 1, wherein the device is made at least in part of at least one of a sweat resistant material, a bacteria resistant material, a waterproof material, and a hypoallergenic material.

14. The breast separator device of claim 1, wherein the device is made at least in part of a foam.

15. The breast separator device of claim 1, wherein the at least one wing is made of a different material than the elongated body.

16. The breast separator device of claim 1, wherein the at least one wing is made of the same material than the elongated body.

17. The breast separator device of claim 1, further comprising an attachment portion sized and dimensioned to be positioned under a band at a bridge of a bra and having a substantially triangular prism shape.

18. The breast separator device of claim 1, further comprising an attachment portion that is rounded at the bottom end.

19. The breast separator device of claim 1, wherein the front surface has a first portion adjacent the top end with a convex shape and a second portion adjacent the bottom end with a concave shape.

20. The breast separator device of claim 1, wherein the top end surface comprises a trapezoid shape with a rounded front edge.

* * * * *